US007477862B2

(12) United States Patent
Takaya et al.

(10) Patent No.: US 7,477,862 B2
(45) Date of Patent: Jan. 13, 2009

(54) CHARGED DEVICE, CLEANING DEVICE, PROCESS CARTRIDGE, TONER, AND IMAGE-FORMING DEVICE THAT USES THESE

(75) Inventors: Muraishi Takaya, Kanagawa (JP); Hiromichi Ninomiya, Kanagawa (JP); Atsushi Sampe, Kanagwa (JP); Yoshiyuki Kimura, Tokyo (JP); Hiroyuki Nagashima, Kanagwa (JP); Hiroshi Hosokawa, Kanagawa (JP); Ken Amemiya, Tokyo (JP); Toshio Koike, Kanagawa (JP); Tokuya Ojimi, Kanagawa (JP); Takaaki Tawada, Kanagawa (JP); Takeshi Shintani, Kanagawa (JP); Yuji Arai, Kanagawa (JP); Takuji Yoneda, Tokyo (JP); Masanori Kawasumi, Kanagawa (JP); Masami Tomita, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 155 days.

(21) Appl. No.: 11/052,069

(22) Filed: Feb. 8, 2005

(65) Prior Publication Data

US 2005/0191081 A1 Sep. 1, 2005

(30) Foreign Application Priority Data

Feb. 9, 2004 (JP) ..... 2004-032364
Feb. 12, 2004 (JP) ..... 2004-034369
Mar. 19, 2004 (JP) ..... 2004-081155

(51) Int. Cl.
*G03G 15/02* (2006.01)

(52) U.S. Cl. ..... 399/100; 399/357

(58) Field of Classification Search ..... 399/100, 399/176, 357
See application file for complete search history.

(56) References Cited

U.S. PATENT DOCUMENTS 5,638,158 A 6/1997 Sanpe et al.

(Continued)

FOREIGN PATENT DOCUMENTS

JP 5-297690 11/1993

(Continued)

OTHER PUBLICATIONS

U.S. Appl. No. 11/512,385, filed Aug. 30, 2006, Tomita.

(Continued)

*Primary Examiner*—David M. Gray
*Assistant Examiner*—Bryan Ready
(74) *Attorney, Agent, or Firm*—Oblon, Spivak, McClelland, Maier & Neustadt, P.C.

(57) ABSTRACT

There is provided a cleaning device for an image-forming device configured so as to be capable of preventing the image quality from deteriorating by being able to prevent the deterioration of the charging state caused by deposits of foreign matter without increasing costs. There is also provided a cleaning member that can make contact with the cleaning target-members. The cleaning member has a portion composed of melamine resin foam for making contact with at least the cleaning target members, and the melamine resin foam has an Asker F hardness of 5 to 25 points and a hardness variation of 5 points or less, and is used on the cleaning target members in a state obtained by heat compression from the original shape. The pressing member is furthermore disposed in contact with the cleaning member.

15 Claims, 24 Drawing Sheets

U.S. PATENT DOCUMENTS

| | | | | |
|---|---|---|---|---|
| 5,893,821 | A * | 4/1999 | Ando et al. | 492/59 |
| 6,628,912 | B2 | 9/2003 | Amemiya et al. | |
| 2002/0081130 | A1 * | 6/2002 | Endo et al. | 399/349 |
| 2003/0039483 | A1 * | 2/2003 | Funabashi | 399/100 |
| 2003/0185588 | A1 * | 10/2003 | Takami et al. | 399/111 |
| 2005/0063728 | A1 * | 3/2005 | Harada et al. | 399/100 |

FOREIGN PATENT DOCUMENTS

| | | | |
|---|---|---|---|
| JP | 6-149012 | | 5/1994 |
| JP | 7-11425 | | 2/1995 |
| JP | 8-106203 | | 4/1996 |
| JP | 2002-108069 | | 4/2002 |
| JP | 2002-169327 | | 6/2002 |
| JP | 2002-221883 | | 8/2002 |
| JP | 2003-29430 | | 1/2003 |
| JP | 2003-66693 | | 3/2003 |
| JP | 2003-66807 | | 3/2003 |
| JP | 2003-91143 | | 3/2003 |
| JP | 3421083 | | 4/2003 |
| JP | 2004330753 | A * | 11/2004 |

OTHER PUBLICATIONS

U.S. Appl. No. 11/736,881, filed Apr. 18, 2007, Hosokawa et al.
U.S. Appl. No. 11/935,106, filed Nov. 5, 2007, Muraishi et al.
U.S. Appl. No. 12/134,701, Jun. 6, 2008, Kosuge et al.

* cited by examiner

ACTUAL GAP MEASUREMENT RESULTS

CHARGED DEVICE, CLEANING DEVICE, PROCESS CARTRIDGE, TONER, AND IMAGE-FORMING DEVICE THAT USES THESE

BACKGROUND OF THE INVENTION

1. Field of the Invention

The present invention relates to copiers, printers, facsimile devices, and other image-forming devices for forming images with electrophotography, and a charged device, cleaning device, process cartridge, and toner that are adopted therein.

2. Description of the Background Art

In this type of electrophotographic image-forming device, a charge with a prescribed polarity is imparted and retained by discharging electricity on the surface of a photoreceptor or other image carrier, the charged photoreceptor surface is exposed to form an electrostatic latent image, toner charged with the same polarity as the charged polarity is fed to the electrostatic latent image, and a toner image is formed. The toner image formed on the surface of the image carrier is transferred to recording paper or another medium, and heat and pressure are applied to fix the image to the recording paper or other medium. Also, since there is residual toner that is not transferred on the surface of the image carrier after the toner image has been transferred, the surface is cleaned with a cleaning blade, cleaning brush, or another cleaning device prior to entering the next charging step.

A conventional configuration of a non-contact method that uses corona discharge is disclosed in Japanese Laid-open Patent Application No. 8-106203 (paragraphs "0002" and "0003"), for example, as a charged device adopted in such an image-forming device. There are drawbacks in a charged device that uses the non-contact method in that ozone, nitrogen oxide, and other corona products associated with corona discharge cause adverse environmental effects, and the charging characteristics can deteriorate when nitric compounds (ammonium nitrate) and other discharge products based on nitrogen oxide are deposited.

In lieu of such a non-contact charged device, also known are charged devices that use a contact method whereby the charged roller is brought into contact with the surface of the image carrier to impart a charge, and charged devices that use a close proximity method whereby the charged roller is brought into close proximity to the surface of image carrier while maintaining a small gap of several microns to several tens of microns to impart a charge.

Normally, a charging bias voltage is applied to the charged roller of charged devices that use the contact or close proximity methods. An AC voltage that has a DC voltage and an interpeak voltage that is no less than double the discharge starting voltage of the DC voltage is superposed and applied as such a charging bias voltage, the electric potential of the latent image carrier is converged to the value of the applied DC voltage by the application of the AC voltage, and a uniform charge can be imparted to the surface of the latent image carrier as a result.

Described next are various problems that need to be solved in charged devices based on the use of the above-described contact and close proximity methods.

[1] First Problem

In charged devices using the above-described close proximity method, a small gap is formed between the surface of the image carrier and the surface of the charged roller, and disclosed in Japanese Laid-open Patent Application No. 2003-66693 (paragraphs "0010" and "0011"), for example, is a technique in which the surface of the latent image carrier is placed in a state of constant etching since the surface of the image carrier is charged by a pulse discharge generated between the small gap. When the surface of the image carrier is cut by the etching phenomenon produced by the charged roller, a film-thinning phenomenon is created whereby the film thickness of the photosensitive layer of the surface thereof is reduced, and it is possible that the charging characteristics may deteriorate and the image quality may decline as these phenomena occur.

For example, Japanese Laid-open Patent Application No. 2003-66693 discloses a method aimed at reducing the film-thinning phenomenon of such a latent carrier, whereby a DC voltage is applied exclusively to the charged roller that makes contact, and, for example, Japanese Laid-open Patent Application No. 2003-91143 (paragraph "0010") discloses a method in which a lubricant is applied to the surface of the latent image carrier.

In the former method, the surface of the image carrier is charged solely by DC voltage and the amount of current flowing to the image carrier is therefore considerably reduced because AC voltage is not applied thereto. In other words, the pulse discharge to the image carrier is reduced, and, as a result, the etching effect on the surface of the image carrier is reduced and the film-thinning phenomenon of the image carrier controlled. Used in the latter method is a solid lubricant application device that is provided exclusively to the charged device independent from the cleaning device of the image carrier, and the surface can be protected by forming a lubricating layer on the surface through the application of zinc stearate or another lubricant, for example, to the surface of the image carrier to increase the abrasion resistance.

There is an additional problem in that the charged roller becomes soiled, which is another reason that the image quality may decline due to the deterioration of the charging characteristics of the image carrier when a charged roller is used. The charged roller is disposed facing the surface of the image carrier which has undergone the cleaning step, but is also disposed in a manner that tends to allow toner, paper dust, and other unwanted matter left behind in the cleaning step to be deposited on the surface of the image carrier. For this reason, the surface friction changes when partial soiling occurs on the charged roller, and, as a result, a homogeneous charge cannot be imparted to the image carrier. In view of the above, for example, Japanese Laid-open Patent Application Nos. 2003-29430 (paragraph "0012"), 7-11425 (paragraph "0023"), and 2002-108069 (paragraph "0026") disclosed conventional methods in which a cleaning blade, a cleaning member in the form of a pad, or a brush is provided to the charged roller, and, for example, Japanese Laid-open Patent Application No. 6-149012 (claim 1) discloses the provision of a cleaning roller equipped with a cleaning blade.

Considering the soiling problems of such a charged roller, the film thinning of the latent image carrier can be reduced in the method for applying DC voltage exclusively to the charged roller as described above, but partial soiling tends to occur in that toner, paper dust, and other unwanted matter is deposited on the surface of the charged roller, and, as a result, the electrical resistance on the surface thereof may become nonuniform. When the uniform charge on the image carrier is degraded, a slight variation in the friction causes image smudges or nonuniformity in the image because AC voltage cannot be applied. Also, in the method in which lubricating oil is applied to the surface of the image carrier described above, the cleaning characteristics in the environmental variations of the image carrier are stabilized by reducing the friction coefficient with the lubricant, but a portion of the toner or paper dust deposited on the surface of the image carrier with reduced friction more easily slips away from the cleaning position, and changing the friction of the surface when toner, paper dust, and other unwanted matter are deposited on the charged roller has the same result as described above with respect to soiling the charged roller.

The lifespan of the image carrier can be extended by inhibiting the film-thinning phenomenon on the surface of the image carrier in this manner, but in recent years, configurations in which the image carrier, the charged device therein, the developing device, and the cleaning device are housed together in the process cartridge are becoming more widespread because of the improved maintenance characteristics, and it is important from the aspect of reducing running costs to make the lifespan of all the housed devices the same, rather than to extend the lifespan of only a portion of the housed devices.

In a configuration for allowing the soiling of the charged roller to be prevented, a configuration for recovering the foreign matter removed from the charged device is required. In the particular case that a blade is used, there is a requirement to control the setting and other parameters of a recovery timing and a recovery unit that is separate from the blade since the blade itself cannot hold the foreign matter. For this reason, the charged device configuration becomes more complicated, resulting in higher costs.

When a cleaning member in the form of a pad or a sponge is used, the captured foreign matter must be retained, but it is difficult to retain the foreign matter simply by bringing the cleaning member into contact with the charged roller. For this reason, when a cleaning structure is provided to the charged roller in either case, a mechanism for capturing foreign matter and a recovery mechanism is required in addition to the charged roller and cleaning structure, and higher costs due to the greater size and complexity of the device are unavoidable. Such drawbacks are not limited to charged devices that simply use a charged roller, but also apply to transfer devices and other devices that may involve contact with the latent image carrier.

[2] Second Problem

While the demand for higher image quality and smaller configurations has increased in recent years, toners with smaller, spherical-shaped particles have come to be used in the development step. There are attempts to densely deposit toner in the electrostatic latent image through the use of such toners. However, the above-described toners with smaller, spherical-shaped particles tend to slide on the cleaning blade in the cleaning step, and cleaning tends to be inadequate. In other words, residual toner on the surface of the image carrier adheres to the charged roller without being cleaned away, and the surface of the photoreceptor cannot be uniformly charged. Therefore, to prevent such a situation, the surface of the charged roller must be cleaned.

For example, Japanese Laid-open Patent Application No. 5-297690 discloses polyurethane foam, polyethylene foam, or another sponge material that serves as a cleaning member of such a charged roller, and, for example, Japanese Laid-open Patent Application No. 2002-221883 discloses a brush roller. These cleaning members remove toner and other deposits by making contact and rubbing against the surface of the charged roller. In the case of sponge material, the deposits are held in the cells contained therein, and in the case of a brush, the deposits are held between the fibers of the brush.

However, there is a limit to the amount of deposits that can be held in the cleaning member, and there is an unresolved issue with regard to maintaining the cleaning characteristics of the cleaning member over a long period of time. In a process cartridge configured with a charged roller, for example, the performance of the charged roller, and consequently the cleaning function of the surface of the charged roller, must be in agreement with the lifespan of the other configurational components, and the above-described cleaning members are inadequate for such an object.

In view of the above, the use of a cleaning member composed of a melamine resin foam having a three-dimensional reticulated structure is disclosed in Japanese Laid-open Patent Application No. 2003-66807, for example, as a replacement to the above-described cleaning members, whereby the performance of the charged roller can be maintained over a long period of time. Such a cleaning member does not allow unwanted matter to clog a single cell as does a conventional sponge material, and the cleaning characteristics of the surface of the charged roller can therefore by maintained over a long period of time.

However, when a configuration is adopted whereby the cleaning member is brought into contact with the charged roller by its own weight, for example, and when contact between the charged roller and cleaning member continues for a long period of time in a state in which the charged device is stopped, a problem is encountered in the sense that a contact mark may be left on the surface of the charged roller, and charging thereafter may not be uniform, leading to the generation of abnormal images. This phenomenon particularly tends to occur when the contact time is extensive at high temperatures.

[3] Third Problem

In order to remove foreign matter deposited on the surface of a charged roller such as that described above, there is disclosed in Japanese Laid-open Patent Application No. 14-169327 a configuration that provides a charged cleaning member that rubs against the surface of the charged roller to remove toner, paper dust, and other unwanted matter on the surface thereof. In other words, the above publication discloses a charged cleaning roller that removes toner, paper dust, and other unwanted matter from the surface of the charged roller by rubbing against the surface in conjunction with the rotation of the charged roller. Such a charged cleaning roller is advantageous in that the cleaning durability thereof is on a par with that of a cleaning pad or another fixed-type charged cleaning member. Furthermore in the above-noted publication, the configuration has a layout arrangement in which the charged roller is disposed above the photoreceptor in the vertical direction, and the charged cleaning roller makes contact with the charged roller by its own weight and is configured to rotate in conjunction with the charged roller. Hereinafter, this arrangement is referred to as an "upper-side arrangement."

However, due to the constraints of the layout arrangement of the entire device, contact cannot be made using the deadweight of the charged cleaning roller when the charged cleaning roller makes contact with the surface of the charged roller at a position lower than the virtual horizontal plane containing the center of rotation of the charged roller. In view of the above, pressure is applied to the shaft of the charged cleaning roller brought into contact with the charged roller so as to rotate in accompaniment therewith. In the layout in FIG. 1, the transfer unit is disposed above the photoreceptor in the perpendicular direction, the charged roller is disposed below, and the charged cleaning roller is disposed below the charged roller in the perpendicular direction. Hereinafter, this arrangement is referred to as a "lower-side arrangement." The charged roller and charged cleaning roller incur the following problems in such a layout.

In other words, extraneous stress is unavoidably placed on the charged roller and the charged cleaning roller in comparison with the upper-side arrangement in which the deadweight was used, because the shaft of the charged cleaning roller is pressed with a constant force to make contact with the charged roller and is caused to rotate in accompaniment therewith. When this configuration is used over a long period of time, the charged roller or the charged cleaning roller becomes soiled, linked rotation does not proceed smoothly, and the cleaning characteristics may worsen. A lubricant is applied to the surface of the photoreceptor in order to protect the surface of the photoreceptor from hazards produced by charging, for example, but when the lubricant is deposited on the surface of the charged roller over time, the coefficient of friction of the contact portion decreases considerably, and linked rotation does not proceed smoothly.

In view of the above, when the contact pressure is set high in order to maintain frictional force, the slide load of the shaft increases and the rotation of the charged cleaning roller is inhibited. Also, the lubricant and additives and the like in the toner are particularly easily deposited on the charged roller, and when the pressure is increased the deposits rub against the charged roller creating a film, and the film produces nonuniform resistance on the surface. For this reason, abnormal images are easily generated due to a nonuniform charge, insufficient charge, or other charge deficiencies.

SUMMARY OF THE INVENTION

A first object of the present invention is to solve the first problem described above, and particularly in view of the cleaning problems of the charged device, an object is to provide a cleaning device that has a configuration capable of preventing the image quality from deteriorating by being able to prevent a deterioration of the charged state caused by deposits of foreign matter without increasing the cost, and to provide a charged device and an image-forming device.

A second object of the present invention is to solve the second problem described above, and more particularly to provide a charged device that can deliver good charging performance from the start of use and maintain the performance over a long period of time without regard to the service environment of the device, to provide an image-forming device and process cartridge in which the charged device is mounted and which can adequately form images, and to further provide a toner that can be used in the image-forming device and process cartridge.

A third object of the present invention is to solve the third problem described above, and more particularly to provide an image-forming device and a process cartridge incorporated therein that can stably charge over a long period of time and yield excellent images when the charged cleaning roller makes contact with the surface of the charged roller at a point lower than the virtual horizontal plane containing the center of rotation of the charged roller to clean the charged roller surface.

A charged device of the present invention comprises a charged roller that has at least an elastic layer around the outside of a metal core, and is applied with a voltage from the exterior to charge the surface of an image carrier, and a charged cleaning roller for cleaning the surface of the charged roller. The charged cleaning roller is provided with a layer composed of a resin foam having a continuous cell structure with a density of 5 to 15 kg/m$^3$ and a tensile strength of 1.7±0.5 kg/cm$^2$ around the outside of the metal core, and the charged roller and charged cleaning roller are disposed at a distance from each other at least prior to mounting on an image-forming device.

A process cartridge of the present invention comprises at least an image carrier for forming latent images and charged means for uniformly charging the surface of the image carrier using a charged member applied with a voltage from an external source, integrally supported and detachably formed on the main body of an image-forming device. The charged means is a charged device which comprises a charged roller having at least an elastic layer disposed around the outside of the core, and a charged cleaning roller for cleaning the surface of the charged roller. The charged cleaning roller is provided with a layer composed of resin foam having a continuous cell structure with a density of 5 to 15 kg/m$^3$ and a tensile strength of 1.7±0.5 kg/cm$^2$ around the outside of the core, and the charged roller and charged cleaning roller are disposed at a distance from each other at least prior to mounting of the process cartridge on the image-forming device.

An image-forming device of the present invention comprises an image carrier for carrying a latent image; charged means for uniformly charging the surface of the image carrier by using a charged member applied with a voltage from an external source; exposure means for causing the surface of the charged image carrier to undergo exposure based on the image data, and writing an electrostatic latent image; developing developing means for feeding toner to the latent image formed on the surface of the image carrier and forming a visible image; and transfer means for transferring the visible image on the surface of the image carrier to the transfer target. A charged device which is the charged means comprises a charged roller that has at least an elastic layer around the outside of a metal core, and is applied with a voltage from the exterior to charge the surface of an image carrier, and a charged cleaning roller for cleaning the surface of the charged roller. The charged cleaning roller is provided with a layer composed of a resin foam having a continuous cell structure with a density of 5 to 15 kg/m$^3$ and a tensile strength of 1.7±0.5 kg/cm$^2$ around the outside of the metal core, and the charged roller and charged cleaning roller are disposed with separation at least prior to mounting the image-forming device.

An image-forming device of the present invention comprises an image carrier for carrying a latent image; charged means for uniformly charging the surface of the image carrier by using a charged member applied with a voltage from an external source; exposure means for causing the surface of the charged image carrier to undergo exposure based on the image data, and writing an electrostatic latent image; developing means for feeding toner to the latent image formed on the surface of the image carrier and forming a visible image; and transfer means for transferring the visible image on the surface of the image carrier to the transfer target. The charged means is a charged device having at least an elastic layer around the outside of a metal core, and a charged cleaning roller for cleaning the surface of the charged roller, which is provided with a layer composed of resin foam having a continuous cell structure with a density of 5 to 15 kg/m$^3$ and a tensile strength of 1.7±0.5 kg/cm$^2$ around the outside of the core, and the charged roller cleaning mode is carried out when the charged device is mounted on the image-forming device.

Toner fed to the developing step of the electronic photographing process in accordance with the present invention is used in an image-forming device which comprises an image carrier for carrying a latent image; charged means for uniformly charging the surface of the image carrier by using a charged member applied with a voltage from an external source; exposure means for causing the surface of the charged image carrier to undergo exposure based on the image data, and writing an electrostatic latent image; developing means for feeding toner to the latent image formed on the surface of the image carrier and forming a visible image; and transfer means for transferring the visible image on the surface of the image carrier to the transfer target. A charged device which is the charged means comprises a charged roller that has at least an elastic layer around the outside of a metal core, and is applied with a voltage from the exterior to charge the surface of an image carrier, and a charged cleaning roller for cleaning the surface of the charged roller. The charged cleaning roller is provided with a layer composed of a resin foam having a continuous cell structure with a density of 5 to 15 kg/m$^3$ and a tensile strength of 1.7±0.5 kg/cm$^2$ around the outside of the metal core, and the charged roller and charged cleaning roller are disposed with separation at least prior to mounting the image-forming device. The toner has a volume-average particle diameter of 3 to 8 μm, and the ratio (Dv/Dn) between the volume-average particle diameter (Dv) and the number-average particle diameter (Dn) being in a range of 1.00 to 1.40.

A cleaning device of the present invention is provided with a cleaning member capable of making contact with cleaning target members. The cleaning member has a portion composed of melamine resin foam for making contact with at least the cleaning target members, and the melamine resin foam has an Asker F hardness of 5 to 25 points and a hardness variation of 5 points or less, and is used on the cleaning target members in a state obtained by heat compression from the original shape.

An image-forming device of the present invention has a cleaning device provided with a cleaning member capable of making contact with cleaning target members. The cleaning member has a portion composed of melamine resin foam for making contact with at least the cleaning target members, and the melamine resin foam has an Asker F hardness of 5 to 25 points and a hardness variation of 5 points or less, and is used on the cleaning target members in a state obtained by heat compression from the original shape.

An image-forming device of the present invention comprises an image carrier; a charged roller for charging the image carrier; and a charged cleaning roller for cleaning the surface of the charged roller disposed in a position that makes contact with the charge roller surface at a position lower than the virtual horizontal plane containing the center of rotation of the charged roller. The device further comprises a bearing for rotatably supporting the rotating shaft of the charged roller, a bearing for rotatably supporting the rotating shaft of the charged cleaning roller, and a bearing holding member of the charged cleaning roller for holding the bearing of the rotating shaft of the charged cleaning roller. The bearing of the rotating shaft of the charged roller and bearing holding member of the charged cleaning roller are integrally formed; and the bearing holding member of the charged cleaning roller is configured so as to hold the bearing of the charged cleaning roller and allow movement in the direction in which the charged roller and the charged cleaning roller move toward or away from each other by way of an elastic member.

A process cartridge of the present invention in which an image carrier, a charged roller for charging the image carrier, and a charged cleaning roller for cleaning the surface of the charged roller disposed in a position that makes contact with the charge roller surface at a position lower than the virtual horizontal plane containing the center of rotation of the charged roller are integrally formed. The cartridge being made detachable with respect to the main body of an image-forming device. There are provided a bearing for rotatably supporting the rotating shaft of the charged roller, a bearing for rotatably supporting the rotating shaft of the charged cleaning roller, and a bearing holding member of the charged cleaning roller for holding the bearing of the rotating shaft of the charged cleaning roller. The bearing of the rotating shaft of the charged roller and bearing holding member of the charged cleaning roller are integrally formed. The bearing holding member of the charged cleaning roller is configured so as to hold the bearing of the charged cleaning roller and allow movement in the direction in which the charged roller and the charged cleaning roller move toward or away from each other by way of an elastic member.

BRIEF DESCRIPTION OF THE DRAWINGS

The above and other objects, features, and advantages of the present invention will become more apparent from the following detailed description taken with the accompanying drawings in which.

DESCRIPTION OF THE PREFERRED EMBODIMENTS

Figure 1:
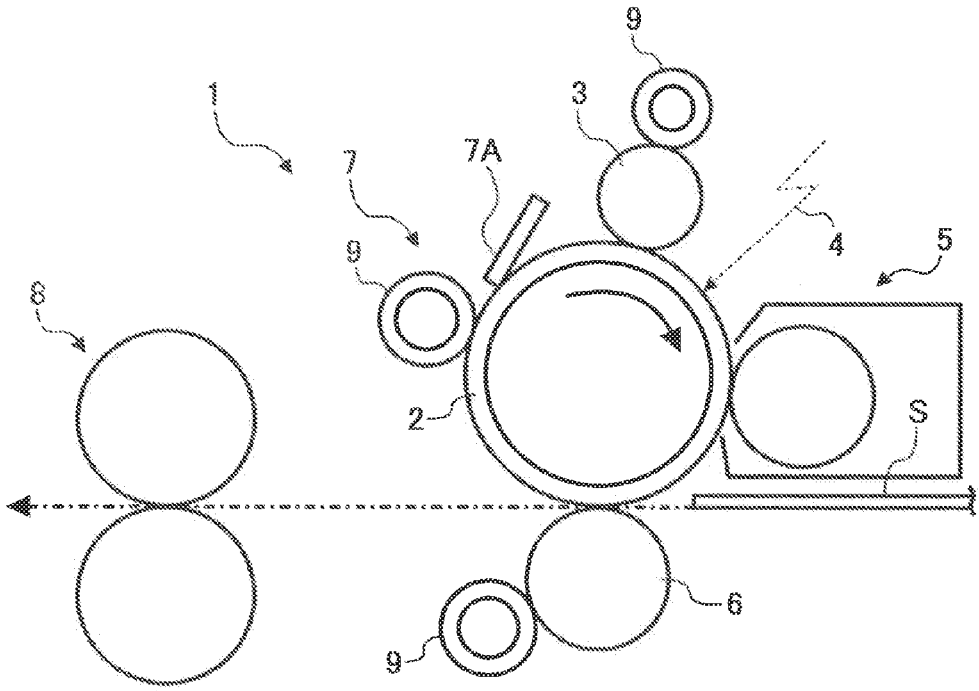
FIG. 1 is a schematic diagram showing the configuration of an image-forming device in which the charged device provided with a cleaning device of the first embodiment of the present invention has been applied.

Preferred embodiments of the present invention will be described hereinafter. It is to be noted that the reference numerals used in each embodiment are independent of the reference numerals of the other embodiments, i.e., the same reference numerals do not always designate the same structural elements.

First Embodiment

The present embodiment is designed to achieve the first object of the present invention described above.

FIG. 1 shows the configuration of an image-forming device in which the cleaning device according to the present embodiment has been applied, and the image-forming device 1 shown in the diagram is provided with a photoreceptor 2 in the form of a drum (hereinafter referred to as "photoreceptor drum") as a latent image carrier. Disposed around the photoreceptor drum 2 are a charged device 3 for carrying out an image formation routine along the direction of rotation (direction of the arrow in the diagram) of the drum 2, a writing device (only the optical path is shown) 4, a developing device 5, a transfer device 6, and a cleaning device 7.

In the image-forming device 1 shown in FIG. 1, a uniform charge is created by the charged device 3 during the rotation of the photoreceptor drum 2, an electrostatic latent image is then formed by the writing device 4 in correspondence to the image information, the electrostatic latent image is converted to a visible image by toner fed from the developing device 5, and the visible image is then transferred to a recording sheet S drawn out from the delivery device (not shown) by way of the transfer device 6. The visible image transferred to the recording sheet S is fixed by the fixing device 8, enabling copies to be output.

In the present embodiment, a photoreceptor drum 2, a charged device 3, a transfer device 6, and other devices are provided to the image-forming device 1 as a member for imparting a charge, that is, a so-called charging device. These devices correspond to cleaning target members that are to be cleaned by the cleaning member 9 that is used for removing residual toner, paper dust, and other foreign matter. The cleaning member 9 for the photoreceptor drum 2 is provided as an addition to the cleaning blade 7A, which is mounted on the normally provided cleaning device 7.

The cleaning member 9 constitutes the characteristic portion of the present embodiment. In other words, the cleaning member 9 has a metal roller as a core, and melamine resin foam is used in the portion that makes contact at least with photoreceptor drum 2, with the charged roller constituting the charged device 3, and with the transfer roller constituting the transfer device 6 as the cleaning target members. The cleaning member 9 shown in FIG. 1 is covered with a foam layer on its surface by attaching melamine resin foam about the peripheral surface of the metal roller as the core. Foam with an Asker F hardness of 5 to 25 points and a hardness variation of 5 points or less is used as the melamine resin foam. The above-described hardness is the value measured when the cleaning member 9 is deformed 1 mm using an Asker F hardness tester, and the compression ratio and layer thickness for maintaining this value are adjusted.

The hardness of the melamine resin foam used in the cleaning member was set to the above-noted setting for the following reasons. There is normally variability in the foaming ratio of foamed members, and there are many pinholes with a diameter of about 1 to 3 mm scattered throughout the surface. For this reason, large pinholes other than these are present during foaming, and product yield worsens when such foamed articles are deemed to be defective. When a large number of such pinholes are present, the cleaning characteristics worsen because the contact surface area is reduced when a foamed article makes direct contact with the cleaning target members, and, as a result, charging and transfer becomes nonuniform. In view of the above, the cleaning member 9 is used in the present embodiment entails after being heated and compressed in the radial direction from the original shape thereof to maintain the above-described hardness.

Compression in the radial direction is different from compression in the axial direction, and this is due to the fact that compression deformation is not biased in the entire cross section of the roller, that is, in the circumferential and axial directions. When compression occurs in an axial direction that corresponds to the lengthwise direction, the compression ratio is high toward the end of the axis, and there is a tendency for the compression ratio to be reduced in the center portion of the axial direction. As a result, the hardness in the cross section in the axial direction becomes uneven and contact nonuniformity is generated. In view of the above, the above-described bias in compression deformation is removed, the aforementioned hardness settings are maintained, and the cleaning target members are provided with uniform contact by performing compression in the radial direction in the present embodiment.

Figure 2:
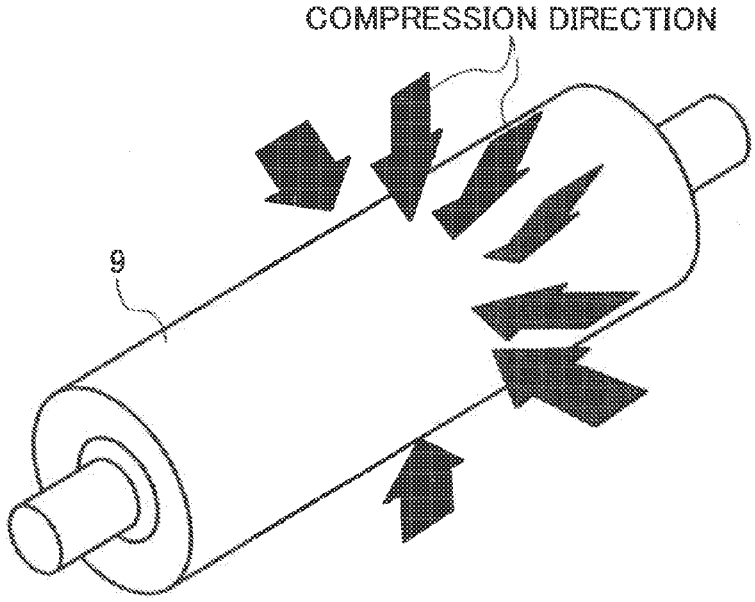
FIG. 2 is a partial perspective view for describing the effect on the cleaning member used in the cleaning device shown in FIG. 1.

The cleaning member 9 used in the present embodiment is provided with the following configuration. That is, melamine resin foam (manufactured by BASF with the trade name Basotect) is mounted with adhesive on the outer surface of a metal core with a diameter of 6 mm to form a foam layer, the outside diameter is first brought to 15 to 16 mm by rotational grinding, and the outside diameter is then brought to 10 to 11 mm in the radial direction by heat compression, as shown by the arrows in FIG. 2. A roller with an outside diameter of 10 mm is thereafter produced by finishing/grinding.

In the image-forming device 1 shown in FIG. 1, the cleaning member 9 is configured to operate by frictional force in coordination with the cleaning target members, and the cleaning member is configured to make contact and create frictional force through its own weight by being arranged on the upper portion of the outer circumferential surface of the charged roller constituting the charged device 3. Frictional force is created with respect to the photoreceptor drum 2 or the transfer roller as a component of the transfer device 6 by forceful contact from an elastic device or the like (not shown). Gears and other transmission mechanisms needed for maintaining an interlinking operating relationship can be dispensed with by adopting an arrangement in which frictional force is used to cause the cleaning member 9 to operate in interlinked fashion with the cleaning target members.

The cleaning member 9 is furthermore disposed in a manner that allows contact to be made with the photoreceptor drum 2, charged device 3, and transfer device 6 as cleaning target members, provides adequate uniform contact when removing foreign matter, and can prevent the cleaning member from being deformed or abraded when contact with the surface of the cleaning target members is maintained over a long period of time. The durable lifespan of the cleaning target members and the cleaning member can be extended thereby.

The present inventors obtained the following results after performing experimentation on image quality by using the cleaning member 9 premised on the above-described configuration. In other words, the environmental conditions used in the experiment were as follows: (1) a high-temperature/high-humidity environment (temperature: 32° C., humidity: 54% RH), (2) a low-temperature/low-humidity environment (temperature: 10° C., humidity: 15% RH), and (3) a reference environment (temperature: 23° C., humidity: 50% RH)

In the environments (1) to (3), 40,000 image formation tests were conducted, and the bias applied to the charged device 3 was adjusted using an AC bias and a DC bias to a voltage value at which the charging state of the photoreceptor drum 2 was stable.

The results in the experiment showed that image nonuniformity due to uneven charging and inadequate transfer did not occur at all in the image after 40,000 image formations, and that pinholes (film-thinning phenomenon in the photoreceptor drum 2, for example) and damage were not observed in the photoreceptor drum 2, the charged roller constituting the charged device 3, or the transfer roller constituting the transfer device 6 as a cleaning target member.

In contrast, when the hardness variation in the melamine resin foam used in the cleaning member 9 was 10 points, charging was uneven and the image was soiled.

The present inventors observed uneven charging and image soiling that were clearly different from the present embodiment when experimenting with a configuration in which a brush with implanted nylon fibers was used to remove foreign matter rubbing against the cleaning target members instead of using the cleaning member 9 with the above-described configuration.

After the experiment, staining in the color of the toner was observed in the cleaning member 9 in which melamine resin foam was used in accordance with the present embodiment. This result indicates that toner, which is the cause of uneven charging and image soiling, was efficiently captured. Foreign matter remained deposited on the filming surface when a cleaning member with another configuration was used, but filming did not occur and toner remained partially deposited when the cleaning member 9 in the present embodiment was used, and it was thus confirmed that toner was captured with good efficiency.

In accordance with the embodiment described above, the cleaning function can be maximized using a heated and compressed melamine resin foam. The reason for this is as follows.

There is commonly a strong relationship between the hardness of melamine resin foam and straightness in the case of a roller, and when the hardness increases, there is a greater possibility that the foam will separate from the cleaning target members because the amount of foam deformation is reduced. For this reason, the straightness of the roller must be increased to make separation more difficult. Also, when the variability in the hardness is considerable across the entire cross section in the case of a roller, the amount of pressure between the roller and the cleaning target members is determined by the differences in the hardness level, and it is difficult to obtain a stable state of contact. Similarly, the presence of pinholes in the foam also creates nonuniformity in the contact state when the foam is used. In view of the above, pinholes can be minimized by heating and compressing the foam from its original shape during foam molding, and setting the hardness to the above-described value in the same manner as with the melamine resin foam of the cleaning member 9 in the present embodiment, whereby the contact state can be made uniform and the cleaning function can be improved.

Next, a modification of the present embodiment is described.

The characteristic feature of the modified example is the provision of a pressure application member that makes contact with the cleaning member, which itself is in contact with the cleaning target members.

Figure 3:
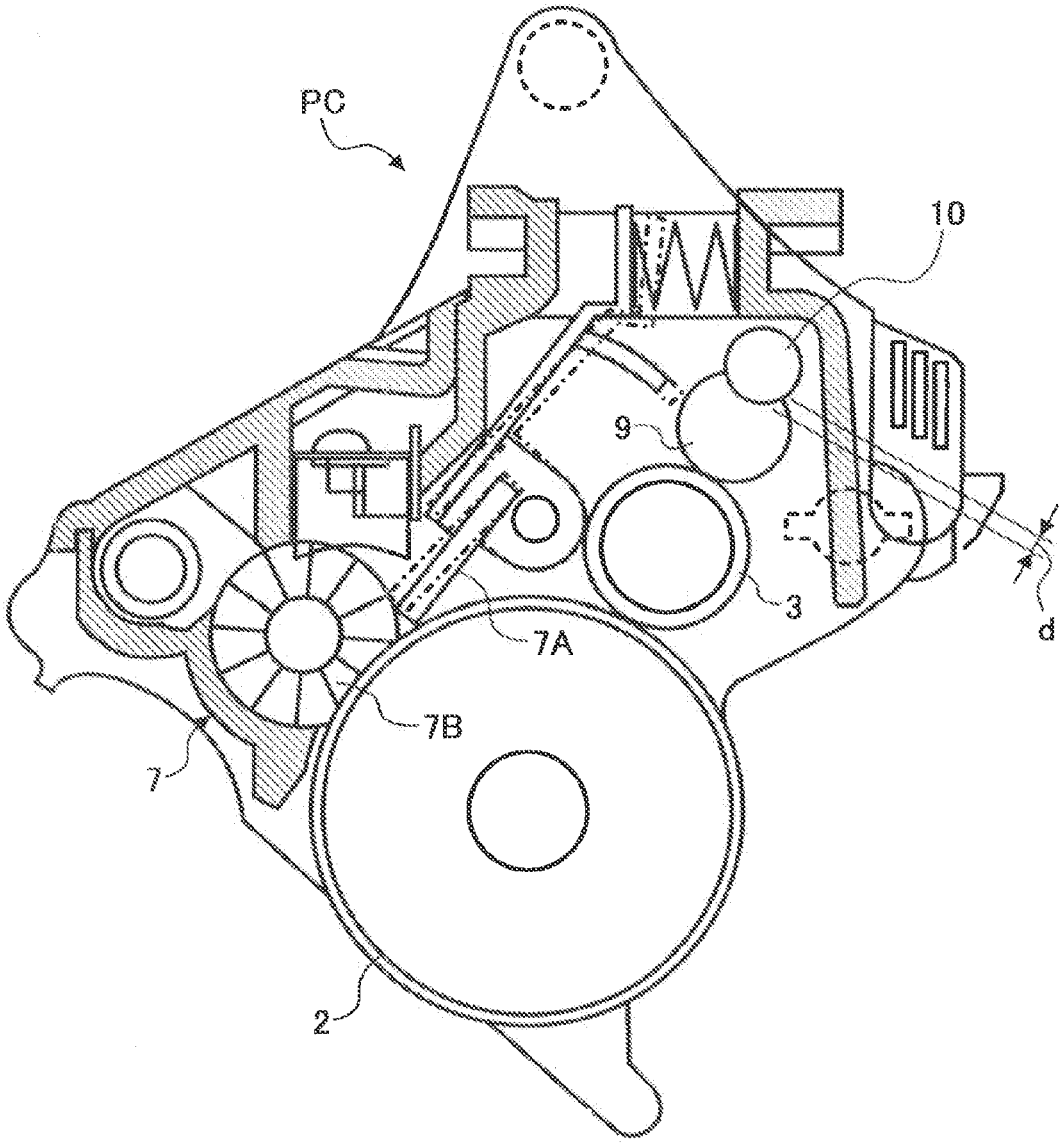
FIG. 3 is a schematic diagram for describing a modification of the cleaning device shown in FIG. 1.

FIG. 3 shows the state in which the photoreceptor drum 2, the charged device 3, and the cleaning device 7 used in the image-forming process shown in FIG. 1 are housed together in the process cartridge PC. In the diagram, a pressure application roller 10 composed of a metal roller is disposed so as to be brought into contact with the charged roller constituting the charged device 3, which is one of the cleaning target members. It should be noted that the configuration adopted in the present modification has a cleaning brush 7B mounted together with the cleaning blade 7A in the cleaning device 7 for cleaning the photoreceptor drum 2, and is different from the configuration shown in FIG. 1 in that no cleaning member is involved.

The cleaning member 9 in contact with the pressure application member 10 composed of a metal roller has a configuration in which the compression direction, arrangement position, and other configurational parameters are set so that the diameter is no more than double the diameter of the pressure application member 10, and the amount of compression deformation (amount shown by the key symbol d in FIG. 3) produced by the pressure application member 10 is 1.5 mm or less. The compression direction in this case is the radial direction in the same manner as in the embodiment shown in FIG. 1.

The pressure application member 10 is configured to compress and deform the cleaning member 9 described above by pressing against the cleaning member 9, can therefore rotate in conjunction with the cleaning member 9 by using the frictional force produced between itself and the cleaning member 9, and is configured so that the amount of bite into the cleaning member 9 is not excessive by setting the compression deformation amount of the cleaning member 9 to the above-described specified value. Accordingly, the capture of foreign matter deposited on the charged roller when a cleaning member 9 is maintained by preventing the rotation of the cleaning member 9 from being affected when the amount of bite has become excessive, and preventing the cleaning member 9 from being affected in its linked operation with the charged roller.

Because of a configuration such as the one described above, the present modification allows the cleaning member 9 provided with melamine resin foam to make contact with the charged roller constituting the charged device 3, and foreign matter deposited on the charged roller to be captured by the melamine resin foam when a linked operational relationship is established by the frictional forced produced between the two. In particular, since the cleaning member 9 is configured so that the pressure application member 10 is pressed and caused to make contact in a state that allows a prescribed amount of compression deformation to be obtained, foreign matter captured by the cleaning member 9 can be pressed into the interior of the cleaning member 9, and since pinholes are furthermore eliminated from the cleaning member 9 itself, contact with the charged device can be made uniform and the capture ratio can be enhanced.

In accordance with the present modification, it is possible to eliminate poor contact between the charged roller of the charged device 3 as a cleaning target member by making the pinholes in the cleaning member 9 easy to crush, because the pressure application member 10 pressed into contact with the cleaning member 9 is composed of a metal roller, and the nonuniform contact state produced by bending or another deformation in the axial direction can be resolved.

In the embodiment described above, since contact with the cleaning target members is improved by using pinhole-free melamine resin foam, which is different from a sponge, the capture ratio of the foreign matter deposited on the cleaning target members is improved and the captured foreign matter does not resurface, making it possible to improve the charging state of a charging device with cleaning target members. More specifically, charging and transfer nonuniformity in the charged device and transfer device are eliminated and the imaging quality can be reliably prevented from worsening. The same applies to cleaning the photoreceptor drum 2, whereby the capture ratio of foreign matter deposited on the photoreceptor drum 2 is improved and the captured foreign matter is not redeposited, so degradation of the image quality can be prevented by carrying out uniform charging.

In accordance with the present embodiment described above, the following characteristics are obtained.

(1) The presence of foreign matter on the cleaning target members is prevented by establishing uniform contact with the cleaning target members with a simple configuration that entails using melamine resin foam; functions carried out by the cleaning target members, more particularly, foreign matter can be prevented from remaining on members whose function is to transfer an electric charge to the charged side, and charging can be improved. Therefore, the degradation of image quality caused by poor charging can therefore be prevented in advance.

(2) The melamine resin foam used as the cleaning member has a set hardness, and uniform contact with the cleaning target members can be assured by compressing the foam from its original form. In other words, the foam-molded member exhibits variability in the foaming ratio as is often seen in sponges for home use and in other types of sponges, there are many pinholes with a diameter of about 1 to 3 mm, and the surface area of contact with the cleaning target members is reduced when such foam is used as the cleaning member. In view of the above, it is possible in the present embodiment to solve the above-described drawbacks by specifying the service mode and hardness of the melamine resin foam in order to prevent a situation in which the contact surface area is partially nonuniform.

(3) The cross section of the melamine resin foam can be configured so as to not allow bias in the compression deformation in the axial direction in particular because the melamine resin foam used as the cleaning member is given the shape of a roller and modeled after the metal roller, and is compressed in the radial direction. In other words, uniform contact with the cleaning target members with which contact is made is difficult to achieve by setting the compression direction setting in the axial direction, but in the present embodiment, variation in such a contact state can be eliminated, and foreign matter can be efficiently removed from the cleaning target members.

(4) Foreign matter can be removed with adequate uniform contact, deformation of the cleaning member and abrasion on the surface of the cleaning target members is prevented, and the durability of the cleaning target members and cleaning members can be improved because the cleaning member is disposed in a manner that allows contact and separation from cleaning target members.

(5) Gears or other transmission mechanisms that are necessary in an interlinking operating relationship are not required because the cleaning member operates in conjunction with the cleaning target members through the use of frictional force produced therebetween. Therefore, the cost required for the cleaning mechanism can be reduced.

(6) The state of contact in the case that melamine resin foam is used as the cleaning member can be made uniform because a pressure application member is provided to the cleaning member that makes contact with the cleaning target members. In the invention according to claim 7 in particular, a uniform contact condition required in the cleaning member for recovering foreign matter can be easily established by allowing the contact pressure of the cleaning member to be specified with respect to the cleaning target members because the pressure application member can be forcibly brought into contact with the cleaning member. Foreign matter from the cleaning target members can be reliably captured because the pinholes in the foam, particularly foam produced when melamine resin foam is used as the cleaning member, are easily crushed.

(7) Because the diameter of the cleaning member is no more than double the diameter of the pressure application member, and the amount of compression set to be 1.5 mm or less, the pressure application member is prevented from excessively biting into the cleaning member, the rotation of the cleaning member is prevented from being inhibited by the load in the case of excessive bite, and it is possible to avoid reduced cleaning function of the cleaning unit with respect to the cleaning target members.

Second Embodiment

Figure 4:
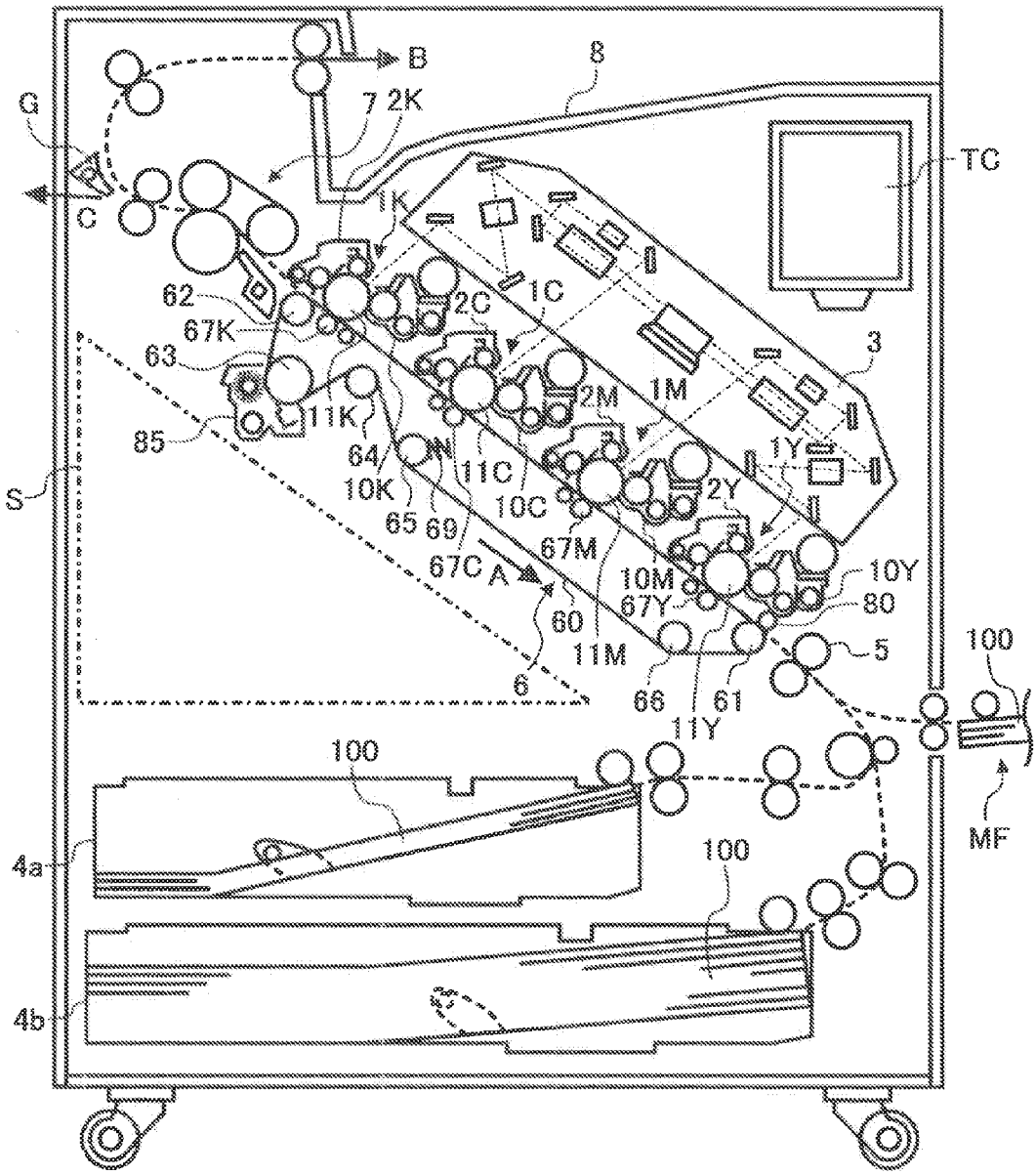
FIG. 4 is a diagram showing the general configuration of the image-forming device according to the second embodiment of the present invention.
Figure 5:
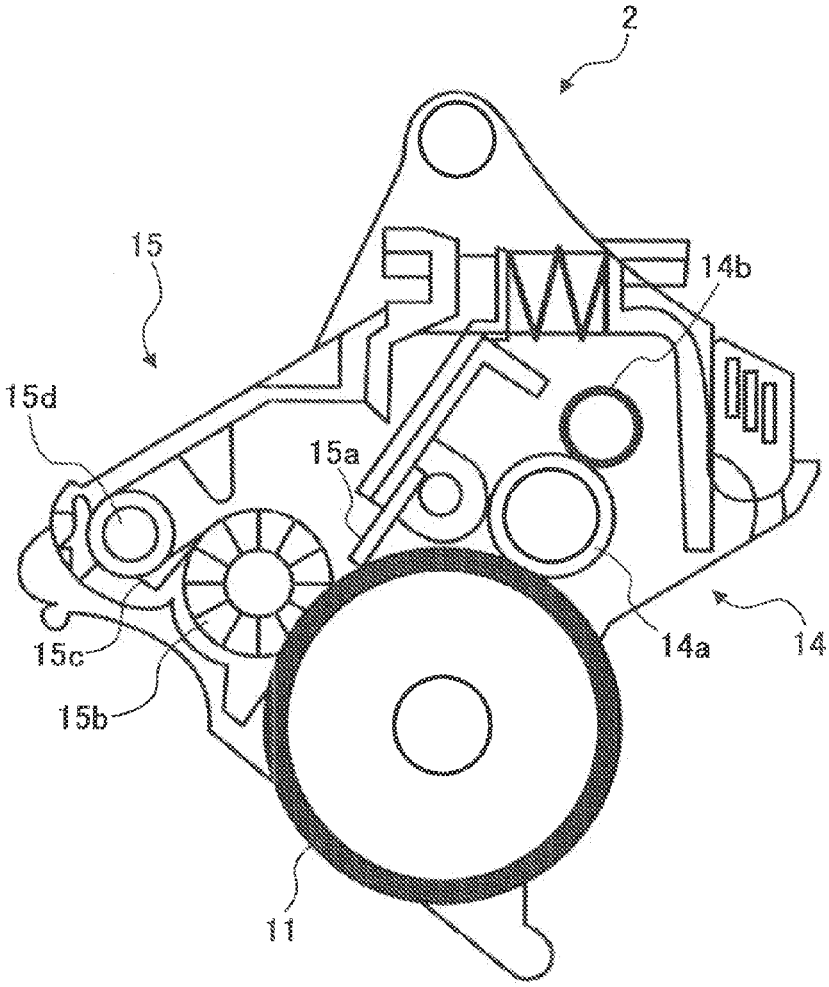
FIG. 5 is a diagram showing the general configuration of the photoreceptor unit.

FIG. 4 is a diagram showing the general configuration of the first concrete example of the image-forming device according to the present embodiment, and FIG. 5 is a diagram showing the general configuration of the photoreceptor unit.

The image-forming device is provided with four image-forming units 1Y, 1M, 1C, and 1K for forming images in each of the colors yellow (Y), magenta (M), cyan (C), and black (K). Is should be noted that the sequence of the colors Y, M, C, and K is not limited to FIG. 1, and other color sequences are possible.

The image-forming units 1Y, 1M, 1C, and 1K are provided with photoreceptor drums 11Y, 11M, 11C, and 11K, respectively, as image carriers, as well as with a charged device, a developing device, and a cleaning device. Also, the image-forming units 1Y, 1M, 1C, and 1K are arranged so as to be parallel to the axis of rotation of the photoreceptor drum and be arrayed at a prescribed pitch in the movement direction of the transfer paper.

A light source, a polygon mirror, an f-θ lens, a reflective mirror, and other components are disposed above the image-forming units 1Y, 1M, 1C, and 1K. Also provided are an optical writing unit 3 for directing light while scanning a laser light over the surface of the photoreceptor drums 11Y, 11M, 11C, and 11K on the basis of the image data, and a transfer unit 6 therebelow that serves as a drive device having a transfer conveyor belt 60 for conveying transfer paper through the transfer portion of the image-forming unit. A cleaning device 85 composed of a brush roller and a cleaning blade is disposed so as to make contact with the outer peripheral surface of the transfer conveyor belt 60. Toner and other foreign matter deposited on the transfer conveyor belt 60 are removed using the cleaning device 85.

The transfer device 6 is provided with a belt fixing type fixing unit 7, a paper discharge tray 8, and other components. Paper supply cassettes 4*a* and 4*b* in which transfer paper 100 is placed are provided to the lower portion of the image-forming device. A manual feed tray MF is used for feeding paper manually from the side surface of the image-forming device.

Additionally, a toner container TC is provided, and a waster toner bottle, a doubled-side/reverse side unit, a power supply unit, and other components (not shown) are mounted in the space S indicated by the chain line.

The developing devices 10Y, 10M, 10C, and 10K serving as a development means are all similarly configured, the developing devices 10Y, 10M, 10C, and 10K use the two-component development method in which only the color of the toner that is used is different, and the developer composed of toner and a magnetic carrier are stored therein.

The developing devices 10Y, 10M, 10C, and 10K are composed of a developing roller facing the photoreceptor drum 11, a screw for conveying and agitating the developer, a toner concentration sensor, and other components. The developing roller is composed of a rotatable sleeve on the outside and a magnet fixed to the inside. Toner is fed from the toner feeding device in accordance with the output of the toner concentration sensor.

The photoreceptor unit 2 is composed of a photoreceptor drum 11 on which an electrostatic image is formed, a charged device 14, and a cleaning device 15, as shown in FIG. 5, and 2Y, 2M, 2C, and 2K all have the same configuration.

The cleaning device 15 is provided with a cleaning blade 15*a* and a cleaning brush 15*b* for cleaning residual transfer toner left behind on the surface of the photoreceptor drum 11. A scraper 15*c* for removing toner deposited on the brush fibers is in contact with the cleaning brush 15*b*. The toner scraped from the cleaning blade 15*a* is moved to the toner conveyance auger 15*d* using the cleaning brush 15*b*, and the recovered waster toner is conveyed to the waste toner storage unit (not shown) by the rotation of the toner conveyance auger 15*d*.

Figure 6:
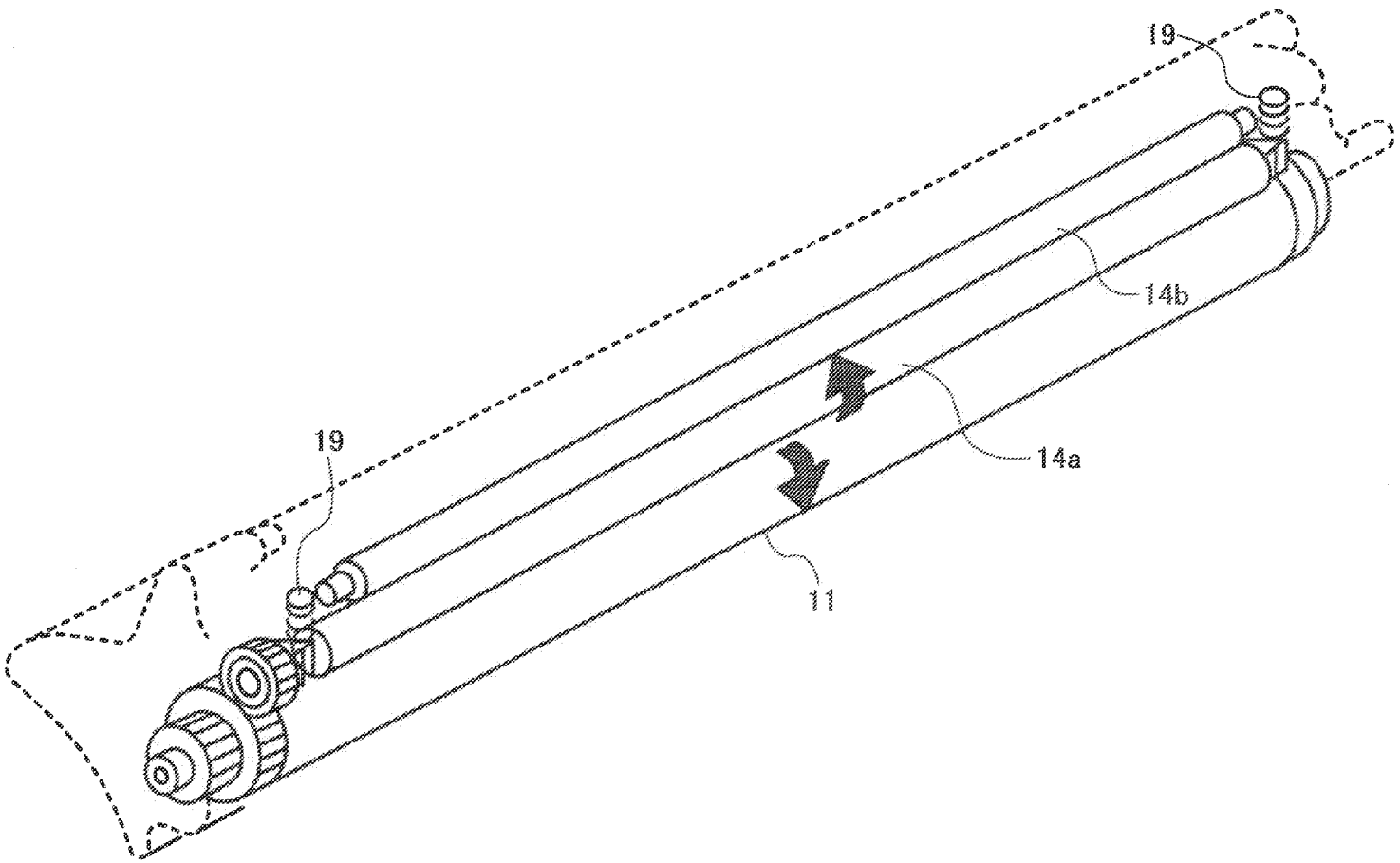
FIG. 6 is a perspective view describing the general configuration of a charged device.

Following is a detailed description of the charged device 14. FIG. 6 is a perspective view describing the general configuration of a charged device of the present embodiment. The charged device 14 is provided with a charged roller 14*a* that is configured with a medium-resistance elastic layer that covers the external side of an electroconductive core as a charged member. The charged roller 14*a* is connected to a power source (not shown), and a prescribed voltage is applied thereto. Also provided are pressure springs 19 and 19, which are urging members for urging both ends thereof toward the photoreceptor drum 11.

The charged roller 14*a* may be disposed so as to allow contact with the photoreceptor drum 11, but in the present embodiment, a small gap if formed in relation to the photoreceptor drum 11. This small gap is not shown, but spacer members having a fixed thickness in the non image-forming area are wound or otherwise mounted at both ends of the charged roller 14*a*, and the setting is completed by bringing the surface of the spacer member into contact with the surface of the photoreceptor drum 11.

A charged cleaning roller 14*b* is provided so that the charged roller 14*a* makes contact with the surface opposite the surface facing the photoreceptor drum 11. The charged cleaning roller 14*b* can be formed by wrapping a cylindrical resin foam around the core, for example. Resin foam having a continuous cell structure in which the physical properties correspond to a density of 5 to 15 kg/m$^3$ and a tensile strength of 1.7±0.5 kg/cm$^2$ is used as the resin foam.

Figure 7:
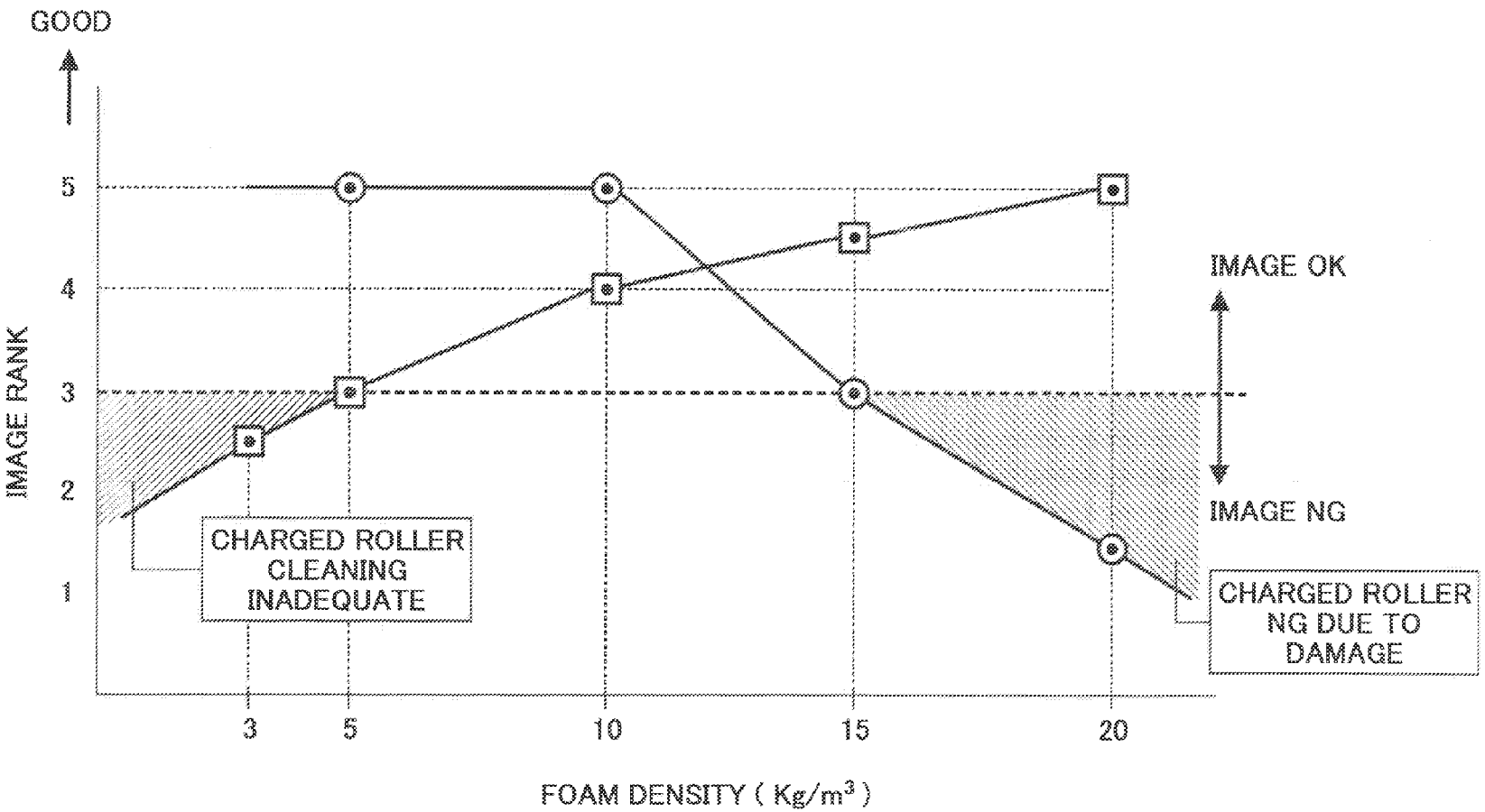
FIG. 7 is a diagram showing the relationship between the value of the density of the resin foam constituting the charged cleaning roller, and the cleaning characteristics and damage resistance of the charged roller surface.
Figure 8:
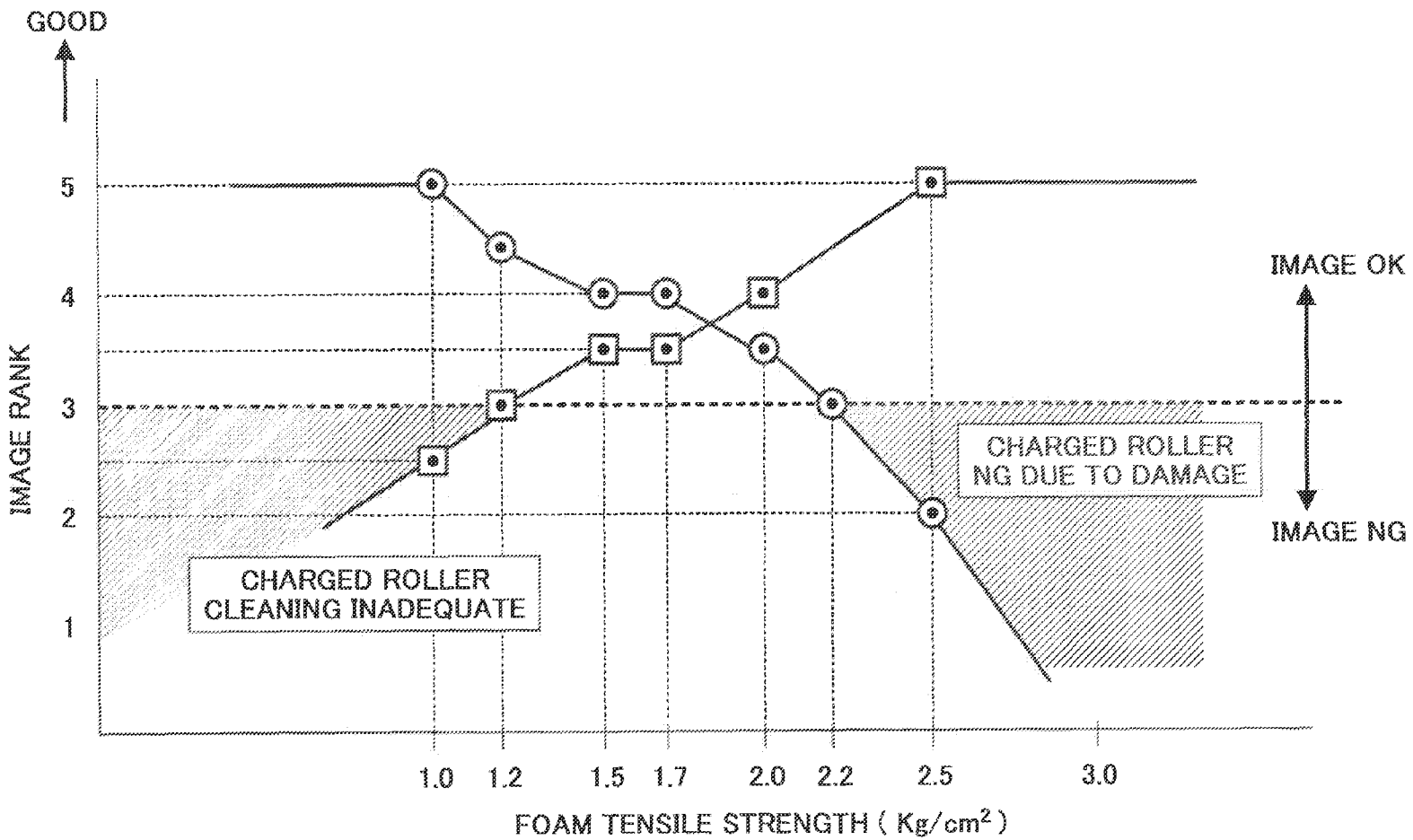
FIG. 8 is a diagram showing the relationship between the value of the tensile strength of the resin foam constituting the charged cleaning roller, and the cleaning characteristics and damage resistance of the charged roller surface.

FIGS. 7 and 8 are diagrams showing the relationship between the density and tensile strength of the resin foam constituting the charged cleaning roller 14*b*, and the cleaning characteristics and damage resistance of the surface of the charged roller 14*a*. The cleaning characteristics and damage resistance of the surface of the charged roller 14*a* can both be evaluated by ranking the formed images. In other words, if the cleaning characteristics of the charged cleaning roller 14*b* are inadequate and the surface of the charged roller 14*a* is soiled, then the photoreceptor drum 11 will not be adequately charged, resulting in blurring. In FIGS. 7 and 8, the square plot marks show the relation to blurs. The higher the image rank is the less blurring there is, and the lower the image rank is the more blurring occurs. Also, when the surface of the charged roller 14*a* is damaged by the rubbing action of the charged cleaning roller 14*b*, unwanted streaking is generated on the image. In FIGS. 7 and 8, the round plot marks show that unwanted streaking has occurred. The higher the image rank is the less unwanted streaking there is, and the lower the image rank is the more unwanted streaking occurs. It should be noted that the image rank is evaluated with 5.0 as the highest rank, and the image rank required in actual practice is 3.0 or higher.

Adequate cleaning performance of the charged cleaning roller 14*b* can be obtained when the density of the resin foam is 5 kg/m$^3$ or more, as shown in FIG. 7. When the density is lower than 5 kg/m$^3$, adequate cleaning performance cannot be obtained, poor charging occurs at an early stage, and image blurring and other unwanted side effects arise. Conversely, when the density is greater than 15 kg/m$^3$, the cleaning performance is good, but the amount of cutting on the surface of the charged roller 14*a* increases, the surface of the charged roller 14*a* is damaged at an early stage, and unwanted streaking occurs in the image.

Adequate cleaning performance of the charged cleaning roller 14*b* can be obtained when the tensile strength of the resin foam is 1.2 kg/cm$^2$ or more, as shown in FIG. 8. When the tensile strength is less than 1.2 kg/cm$^2$, the strength is inadequate, the resin foam becomes ragged at an early stage, and cleaning performance is not demonstrated. Conversely, when the tensile strength is greater than 2.2 kg/cm$^2$, the cleaning performance is good, but damage is inflicted on the surface of the charged roller 14*a* at an early stage, and unwanted streaking occurs in the image.

Therefore, the physical properties of the resin foam constituting the charged cleaning roller 14*b* must correspond to a density of 5 to 15 kg/m$^3$ and a tensile strength of 1.7±0.5 kg/cm$^2$. The resin foam having a continuous cell structure with a density in the above-described range shows a reticulated form having very fine pores, and toner and other deposits on the surface of the charged roller 14*a* can be shaved off using the skeletal portion of the foam. Also, the resin foam with a tensile strength in the above-described range exhibits a brittle characteristic and is peeled away by the frictional force received on the contact surface with the charged roller 14*a*. Since toner and other deposits held inside the cells of the resin foam are peeled away together at this time, deposits are not accumulated in the cells of the resin foam as is the case with resin foams used in prior art, and cleaning can always be carried out with a fresh surface. Excellent cleaning performance can also be obtained over a long period of time without damaging the surface of the charged roller.

The characteristics of the resin foam described above can be better demonstrated when the ratio of extension of the resin foam is in a range of 20 to 40%.

Among resin foams that exhibit the above-described physical properties, melamine resin foam is particularly preferred. Deposits on the charged roller 14*a* can easily be scraped or peeled away because foam that is formed with melamine resin has hard reticulated fibers. A fresh surface of the charged cleaning roller 14*b* can always be in contact with the surface of the charged roller 14*a* and good cleaning performance can be maintained because the resin foam has excellent cleaning characteristics and brittle characteristics as described above.

The charged cleaning roller 14*b* is rotatably supported, makes contact with the surface of the charged roller 14*a* by its own weight, and rotates in conjunction with the rotation of the charged roller 14*a* in the direction of the arrow shown in FIG. 6. Thus, by configuring the charged cleaning roller 14*b* to be driven by the rotation of the charged roller 14*a*, the charged cleaning roller 14*b* does not require a drive device and the configuration can be simplified. Also, adequate cleaning performance can be obtained without requiring a particular pressing force to make contact with the surface of the charged roller 14*a* because the charged cleaning roller 14*b* is composed of the above-described resin foam.

The charged cleaning roller 14*b* is preferably furthermore provided with a sliding mechanism for sliding in the lengthwise direction in association with the rotation of the charged roller 14*a*. The mechanism is not shown, but it is possible to use a mechanism or other arrangement in which bearings are provided to the ends of the core of the charged cleaning roller 14*b*, for example, and are designed to strike the cam surface of the gears having a sliding cam, and in which the charged cleaning roller 14*b* slides in the lengthwise direction along the uneven surface of the cam when the gears with a sliding cam rotate in association with the rotation of the charged roller 14*a*.

Thus, the surface of the charged roller 14*a* can be uniformly cleaned by tilting the charged cleaning roller 14*b*. In particular, paper dust is often generated from the edges of the recording paper, so the position of the deposits on the photoreceptor drum 11 is therefore shifted to one side, and consequently deposits also occur unevenly on the surface of the charged roller 14*a* as well. In view of the above, cleaning can be made uniform in response to these predicable deposits by tilting the charged cleaning roller 14*b*.

In a charged device 14 provided with the above-described charged roller 14*a* and charged cleaning roller 14*b*, when contact between the two continues over a long period of time while the apparatus is stopped, striped contact marks are generated on the surface of the charged roller 14*a* where the charged cleaning roller 14*b* made contact. The present inventors studied the cause of these contact marks and it became apparent that the marks were the result of deposits of a substance originating from the resin foam constituting the charged cleaning roller 14b. It is possible that such conditions arise between the time, for example, the charged device is manufactured and the time the image-forming device is mounted, or between the time the process cartridge with the charged device installed is manufactured and the time the process cartridge is mounted in the image-forming device, or in the case that the image-forming device is not used over a long period of time. When a contact mark such as that described above is formed on the surface of the charged roller 14*a*, the resulting images are abnormal images in which blank areas or distortions occur in fixed intervals because the surface of the photoreceptor drum 11 facing the portion with the contact mark is not adequately charged immediately after image-forming operations are started.

In order to avoid producing such abnormal images, the charged device 14 is configured with the charged roller 14*a* and charged cleaning roller 14*b* disposed with separation at least prior to mounting the image-forming device.

Figure 9A:
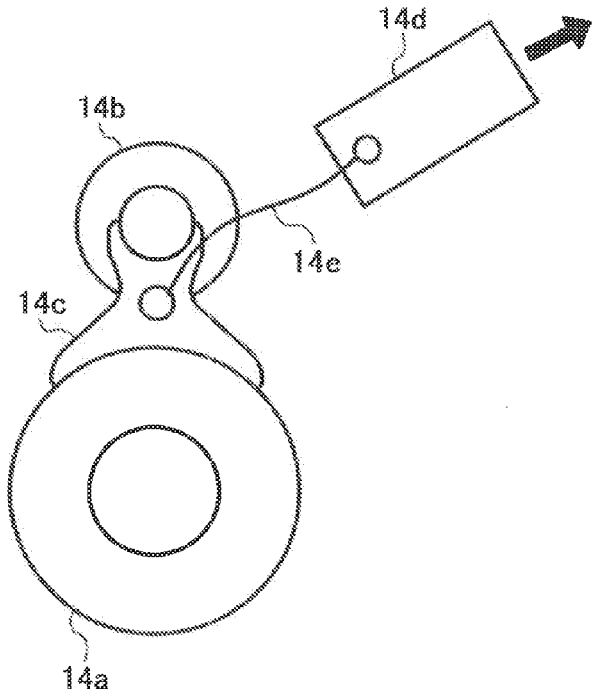
FIGS. 9A to 9C are cross-sectional diagrams showing an example of a configuration in which the charged roller and the charged cleaning roller are disposed at a distance from each other.
Figure 9B:
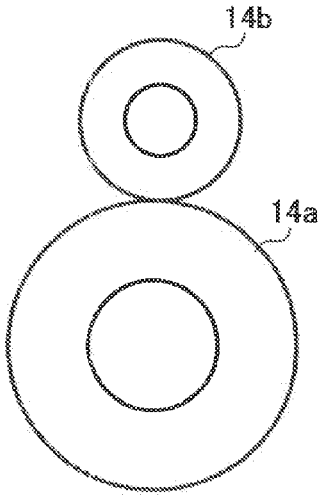
Figure 9C:
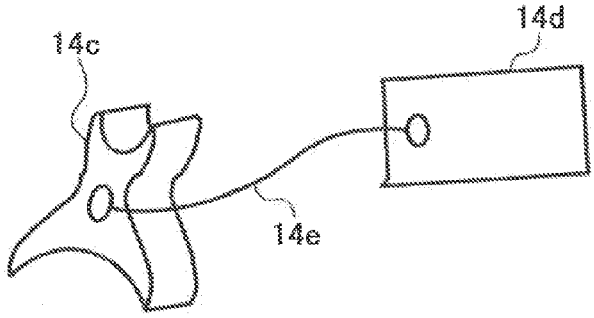

FIGS. 9A to 9C are cross-sectional diagrams showing an example of a configuration in which the charged roller 14*a* and the charged cleaning roller 14*b* are disposed at a distance from each other. A spacer member 14*c* formed with resin or the like shown in FIG. 9*c* is used as the separation holding member for separating the charged roller 14*a* and the charged cleaning roller 14*b*. A tag 14*d* is attached to the spacer member 14*c* with a wire 14*e*. One portion of the spacer member 14*c* is fitted around the exposed core at both ends in the lengthwise direction of the charged cleaning roller 14*b*, as shown in FIG. 9A, and the other portion is brought into contact with the surface of the end portion of the charged roller 14*a* to hold the two rollers apart. When the charged device is mounted in the image-forming device, the spacer member 14*c* connected to the wire 14*e* is removed by pulling the tag 14*d* in the direction of the arrow shown in FIG. 9A, and the charged cleaning roller 14*b* makes contact with the surface of the charged roller 14*a*, as shown in FIG. 9B.

By adopting such a configuration, the charged roller 14*a* and charged cleaning roller 14*b* are held with separation, and contact marks are not produced by the charged cleaning roller 14*b* on the charged roller 14*a*, even in cases such as when a long period of time passes between the manufacture of the charged device and its installation in the image-forming device.

The separation holding member for separating the charged roller 14*a* and the charged cleaning roller 14*b* is not limited to the above-described spacer member 14*c*, and, for example, a member or other device that lifts the charged cleaning roller 14*b* so that it does not make contact with the surface of the charged roller 14*a* may be used.

Also, the charged device 14 may be provided with a separation/contact device for causing the charged roller 14*a* and the charged cleaning roller 14*b* to separate or make contact. Examples of the separation/contact device include a cam or other device for causing contact with both ends of the shaft of the charged cleaning roller 14*b*. The camshaft is rotatably supported, and when the charged device 14 is manufactured, the camshaft is fixed in a state in which the charged cleaning roller 14*b* is separated from the charged roller 14*a*. When the charged device 14 is mounted on the image-forming device, the cam is driven to cause the charged cleaning roller 14*b* to make contact with the surface of the charged roller 14*a*. The same effect as providing the separation holding member described above can thereby be obtained.

Such a separation/contact device can also be effectively used when image-forming device is in service. In other words, during normal image-forming operations, the charged cleaning roller 14*b* is brought into contact with the charged roller 14*a*, and when image formation is complete, the cam is reversed to create separation between the charged roller 14*a* and charged cleaning roller 14*b*. The timing for separating the charged cleaning roller 14*b* can be appropriately established, and the charged roller 14*a* and charged cleaning roller 14*b* can thereby be brought into contact only when necessary.

The charged device 14 described above is integrally supported together with the photoreceptor, and may also be used as a process cartridge detachably formed in the main body of the image-forming device. The process cartridge may be configured to additionally include any device selected from a developing device and a cleaning device. Also, the configuration of the charged device 14 is the configuration described above in which the charged roller 14*a* and charged cleaning roller 14*b* are disposed at a distance from each other at least prior to mounting the image-forming device.

Described next is a second concrete example of the image-forming device related to the present embodiment.

The general configuration of the image-forming device and charged device is the same as that shown in FIGS. 4 to 6. The materials and other aspects of the charged roller 14*a* and charged cleaning roller 14*b* are the same as those described above, and a description thereof is therefore omitted. However, in the second concrete example, the charged roller 14*a* and charged cleaning roller 14*b* of the charged device 14 do not need to be separated. Based on experimentation by the inventors, it was learned that when contact marks on the surface of the charged roller 14*a* are produced as a result of extended contact between the charged roller 14*a* and charged cleaning roller 14*b* over a long period of time, a clean surface of the charged roller 14*a* could be obtained again by carrying out cleaning operations with the charged cleaning roller 14*b*.

In view of the above, in the second concrete example, the charged roller 14*a* and charged cleaning roller 14*b* are in mutual contact when the charged device 14 is manufactured, and when the charged device 14 is mounted in the image-forming device, the charged roller cleaning mode is carried out for a fixed length of time. Even if a contact mark is present on the surface of the charged device 14, it can thereby removed and adequate charging performance can be obtained immediately after the image-forming device begins service. When the charged device 14 is integrated together with the photoreceptor to form the process cartridge, the above-noted charged roller cleaning mode can be carried out when the process cartridge is mounted in the image-forming device.

The charged roller cleaning mode is performed by idling the charged roller 14*a*. Since the charged cleaning roller 14*b* is placed in contact with the surface of the 14*a* by its own weight, the charged cleaning roller 14*b* rotates in conjunction with the rotation of the charged roller 14*a*, and contacts marks formed on the surface of the charged roller 14*a* are removed. Also, idling the charged roller 14*a* prevents other devices from operating in linked fashion, and is an effective technique.

The problem related to both the first and second concrete examples of the image-forming device of the present embodiment is one that occurs when the image-forming device has not used been for a long period of time, and the contact between the charged roller 14*a* and charged cleaning roller 14*b* has continued with the apparatus in the OFF state. Contact marks of the charged cleaning roller 14*b* on the charged roller 14*a* may still occur in this case. It is also known that this phenomenon is more readily observed in high temperature conditions.

In view of the above, the image-forming device of the present embodiment has a device for detecting the length of time the image-forming device has been stopped and the temperature inside the machine when the image-forming device is stopped, and has a mechanism for carrying out the charged roller cleaning mode in accordance with the detection results prior to starting the next imaging operation.

Figure 10:
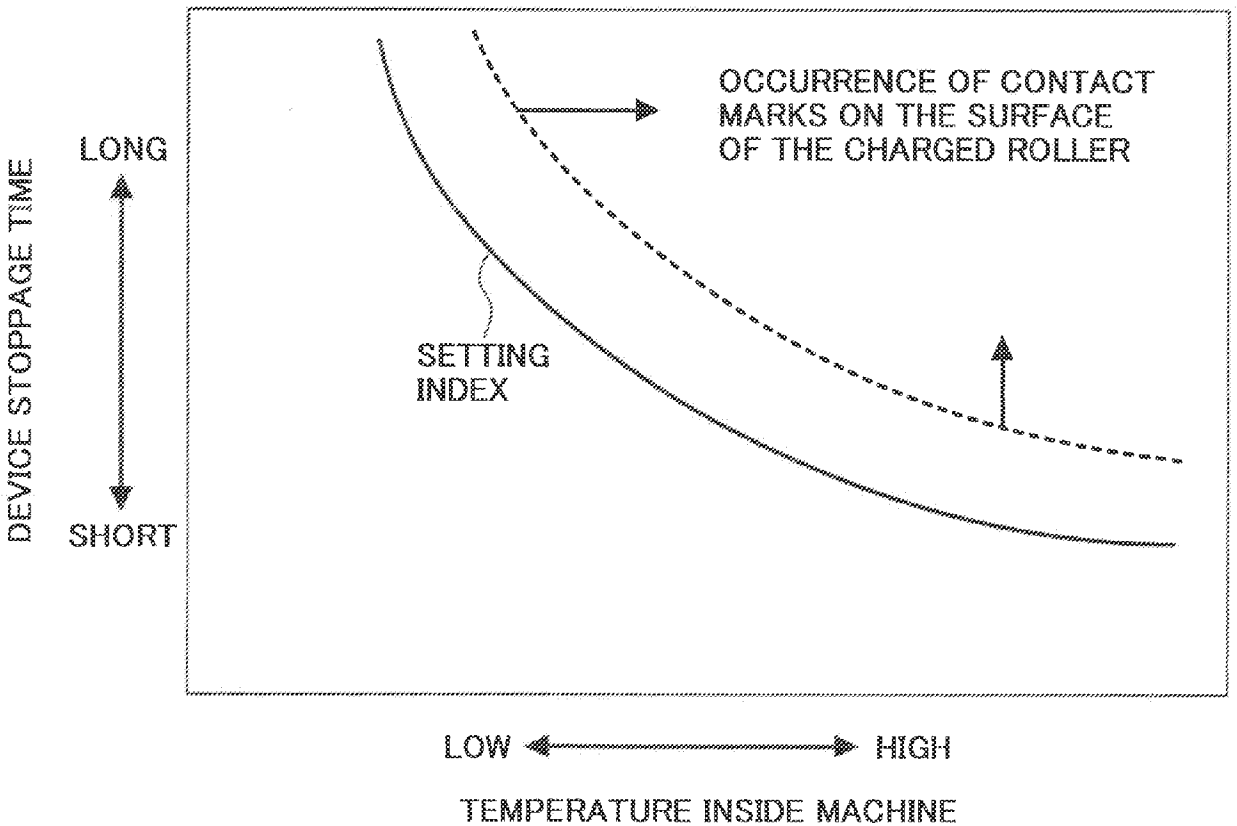
FIG. 10 is a diagram showing the relationship between the stoppage time of the image-forming device and the temperature inside the machine.
Figure 11:
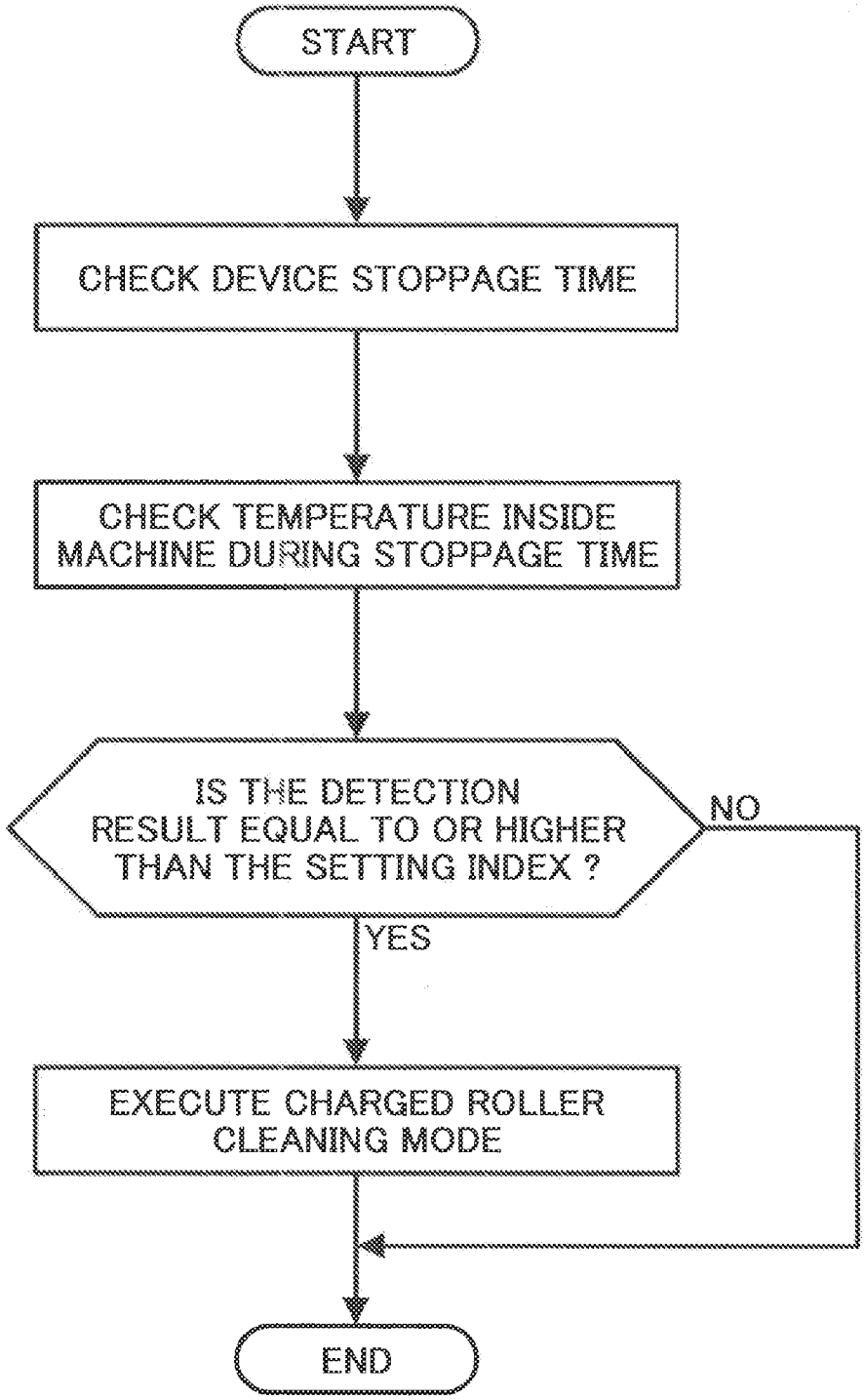
FIG. 11 is a flowchart of the charged roller cleaning carried out prior to the start of imaging operation.

FIG. 10 is a diagram showing the relationship between the stoppage time of the image-forming device and the temperature inside the machine, and FIG. 11 is a flowchart of the charged roller cleaning carried out prior to the start of imaging operation. As a result of studying the relationship between the detected stoppage time and the temperature inside the machine when the image-forming device is stopped, it was found that contact marks are formed on the surface of the charged roller 14*a* when the relationship is plotted in the upper right hand area above the dotted line of FIG. 10. Therefore, when the apparatus stoppage time and the temperature inside the machine are in this region, the surface of the charged roller 14*a* must be cleaned to remove the contact mark prior to starting imaging operation. Conversely, if the relationship is plotted in the lower left hand side, a contact mark is not produced, and it is therefore unnecessary to clean the surface of the charged roller 14*a*. In view of the above, a setting index is provided below the dotted line with a margin, and when the detection results of the apparatus stoppage time and the temperature inside the machine are greater than the setting index, the charged roller cleaning mode is carried out, as shown in FIG. 11.

By providing such a mechanism, even if a contact mark is produced by the charged cleaning roller 14*b* on the surface of the charged roller 14*a* as a result of the image-forming device having stopped for a long period of time, the contact mark is removed and an adequate charging performance of the charged roller 14*a* can be obtained.

Figure 12:
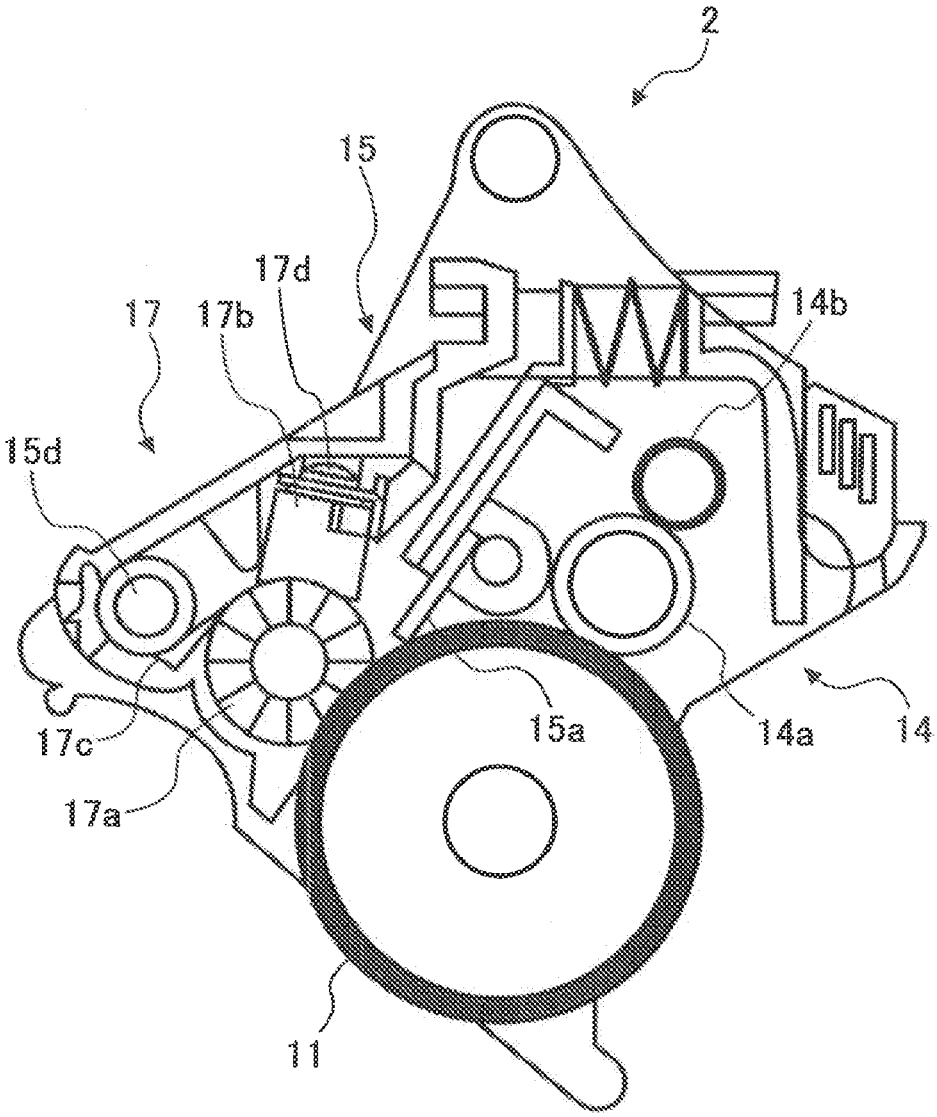
FIG. 12 is a diagram showing the configuration of the photoreceptor unit provided with a lubricant application device.

The image-forming device of the present embodiment may be provided with a lubricant application device for applying lubricant to the surface of the photoreceptor drum 11. FIG. 12 is a diagram showing the configuration of the photoreceptor unit provided with a lubricant application device. Configurations other than the lubricant application device 17 are the same as the photoreceptor unit shown in FIG. 5.

The lubricant application device 17 is principally composed of a solid lubricant 17*b*, a brush-shaped roller 17*a* for making contact with the solid lubricant 17*b* to scrape up the lubricant and feed it to the surface of the photoreceptor drum 11, a brush-shaped roller scraper 17*c* for removing toner deposited on the brush-shaped roller 17*a*, and a pressure spring 17*d* for pressing the solid lubricant 17*b* to the brush-shaped roller 17*a* with a prescribed pressure.

Examples of the solid lubricant 17*b* molded into the form of a block that may be used include lead oleate, zinc oleate, copper oleate, zinc stearate, cobalt stearate, iron stearate, copper stearate, zinc palmitate, copper palmitate, zinc linoleate, and other fatty acid metal salts; and polytetrafluoroethylene, polychlorotrifluoroethylene, polyvinylidene fluoride, polytrifluorochloroethylene, dichlorodifluoroethylene, tetrafluoroethylene-ethylene copolymer, tetrafluoroethylene-oxafluoropropylene copolymer, and other fluororesins.

The brush-shaped roller 17*a* has a shape that extends in the axial direction of the photoreceptor drum 11. The pressure spring 17*d* urges the block of solid lubricant 17*b* toward the brush-shaped roller 17*a* so that substantially the entire block is used. The solid lubricant 17*b* is a consumable item and the thickness thereof is reduced with the passage of time, the solid lubricant 17*b* is taken up because it is constantly forced to make contact with the brush-shaped roller 17*a* by the pressure applied by the pressure spring 17*d*, and the lubricant is thereafter fed and applied to the photoreceptor drum 11. Here, the brush-shaped roller 17*a* doubles as the cleaning brush and acts to move the toner brushed off by the cleaning blade 15*a* toward the toner conveyance auger 15*d*.

It should be noted that the lubricant application device 17 is not limited to the above-described configuration, and also possible are a configuration in which the solid lubricant 17*b* is brought into direct contact and applied to the surface of the photoreceptor drum 11, a configuration in which a powdered lubricant is fed to the surface of the photoreceptor drum 11, and other configurations.

Thus, by providing a device for applying lubricant to the surface of the photoreceptor drum 11, the coefficient of friction of the surface of the photoreceptor drum 11 can be lowered, the adhesive force between the toner and the surface of the photoreceptor drum 11 can be reduced, the transferability of the developed toner can be increased, and the cleaning performance of the cleaning blade 15*a* for residual toner on the surface of the photoreceptor drum 11 after transfer can be improved. In particular, this is an effective device when using a toner with smaller and rounder fine particles, as described below. By adequately cleaning the residual toner on the surface of the photoreceptor drum 11, stains on the surface of the charged roller 14*a* can be reduced, and the lifespan of the charged cleaning roller 14*b* can consequently be extended.

In the image-forming device related to the present embodiment, the toner used in the developing device 10 has a volume-average particle diameter of 3 to 8 μm, and a preferable toner has a small particle diameter in which the ratio (Dv/Dn) between the volume-average particle diameter (Dv) and the number-average particle diameter (Dn) is in the range of 1.00 to 1.40, and has a narrow particle size distribution. Toner can be densely deposited to the latent image by using toner with a small particle diameter. Also, the charge amount distribution of the toner can be made uniform, a high-quality image with little surface covering can be obtained, and the transfer ratio can be increased by narrowing the particle diameter distribution. Since the amount of oppositely charged toner is reduced, staining on the surface of the charged roller 14*a* can be reduced as well, and the lifespan of the charged cleaning roller 14*b* can be extended.

Figure 13A:
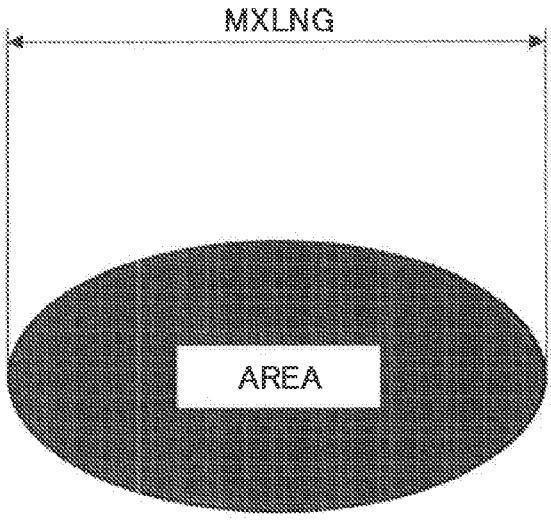
FIGS. 13A and 13B are diagrams that schematically show the shape of the toner in order to describe the shape factors SF-1 and SF-2.
Figure 13B:
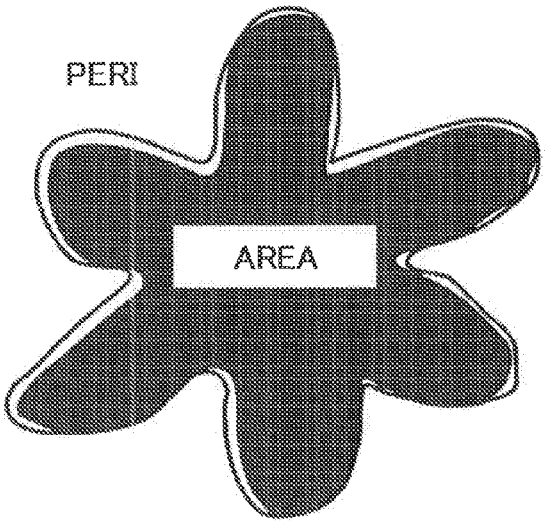

The toner used in the developing device 10 is preferably a spherical toner that can be prescribed by the following shape factor values SF-1 and SF-2. FIGS. 13A and 13B are diagrams that schematically show the shape of the toner in order to describe the shape factors SF-1 and SF-2.

The shape factor SF-1 indicates the roundness of a toner particle, as expressed by the Eq. (1) shown below. That is, the shape factor SF-1 is obtained by projecting the toner particle shape onto a two-dimensional plane, squaring the maximum length MXLNG of the projected shape, dividing the squared value by the area AREA of the projected shape, and multiplying the divided value by 100π/4.

$$SF\text{-}1=\{(\mathrm{MXLNG})^2/\mathrm{AREA}\}\times(100\pi/4) \qquad \text{Eq. (1)}$$

The shape of the toner is perfectly spherical when the value of SF-1 is 100, and the larger the value of SF-1 is, the more indeterminate the shape of-the toner shape is.

The shape factor SF-2 shows the ratio of unevenness of the shape of the toner, and is expressed by Eq. (2) shown below. That is, the shape factor SF-2 is obtained by projecting the shape of the toner particle onto a two-dimensional plane, squaring the peripheral length PERI of the projected shape, dividing the squared value by the area of the projected shape AREA, and multiplying the divided value by 100π/4.

$$SF\text{-}2=\{(\mathrm{PERI})^2/\mathrm{AREA}\}\times(100\pi/4) \qquad \text{Eq. (2)}$$

Unevenness is not present on the surface of the toner when the value of SF-2 is 100, and the larger the value of SF-2 is, the more marked the unevenness of the toner surface is.

The shape factors are specifically measured by taking a picture with a scanning electron microscope (S-800: manufactured by Hitachi, Ltd.) and introducing the picture to an image analyzing apparatus (LUSEX3 by Nireco Corporation) to analyze and calculate the values.

The toner of the present embodiment has an SF-1 value that is in the range of 100 to 180, and an SF-2 value that is in the range of 100 to 180. When the shape of the toner approaches a spherical shape, the contact between toner particles or between the toner and the photoreceptor drum 11 approaches a point contact. Therefore, the fluidity increases as the adsorptive force between toner particles weakens, the adhesive strength of the toner to the surface of the photoreceptor drum 11 also decreases, and the transfer ratio increases. On the other hand, since a spherical toner easily enters the gap between the cleaning blade 15*a* and the photoreceptor drum 11, the toner shape factors SF-1 and SF-2 are preferably 100 or higher. Also, when the SF-1 and SF-2 increase in magnitude, toner scatters over the image and the image quality is reduced. For this reason, SF-1 and SF-2 preferably do not exceed 180.

The toner that can be used in the image-forming device of the present embodiment is a toner obtained by a process in which a toner material solution in which at least a polyester, a coloring agent, a release agent, and a polyester prepolymer having a functional group containing a nitrogen atom, are dispersed in an organic solvent is caused to undergo a crosslinking and/or extension reaction in an aqueous solution. The structural materials and manufacturing method of the toner is described below.

(Modified Polyester)

The toner of the present embodiment contains modified polyester (i) as the binder resin. The modified polyester (i) may be a polyester resin in which bonds other than ester bonds exist, or a polyester in which resin components that have differing structures in the polyester resin are bonded through covalent bonding, ion bonding, or another type of bonding. This more specifically refers to a modified polyester in which an isocyanate group or another functional group that reacts with a carboxylic acid group or a hydroxyl group is introduced to polyester terminals, and is caused to react with an active hydrogen compound to modify the terminals.

Examples of the modified polyester (i) include a urea-modified polyester obtained by reacting a polyester prepolymer (A) having an isocyanate group, and an amine (B). Examples of the polyester prepolymer (A) having an isocyanate group include a polycondensate of polyol (PO) and polycarboxylic acid (PC), and compounds obtained by reacting polyester having an active hydrogen group with a polyisocyanate (PIC). Examples of the active hydrogen group possessed by the above-described polyester include hydroxyl (alcoholic hydroxyl group, phenolic hydroxyl group), amino, carboxylic, and mercapto groups, and preferable among these is the alcoholic hydroxyl group.

The urea-modified polyester is produced in the following manner. Examples of polyol compounds (PO) include dihydric alcohol (DIO) and trihydric and higher polyol (TO), and (DIO) alone or a mixture of (DIO) and a small amount of (TO)

is preferred. Examples of dihydric alcohols (DIO) include alkylene glycols (ethylene glycol, 1,2-propylene glycol, 1,3-propylene glycol, 1,4-butanediol, 1,6-hexanediol, or the like); alkylene ether glycols (diethylene glycol, triethylene glycol, dipropylene glycol, polyethylene glycol, polypropylene glycol, polytetramethylene ether glycol, or the like); alicyclic diols (1,4-cyclohexane dimethanol, hydrogenated bisphenol A, or the like); bisphenols (bisphenol A, bisphenol F, bisphenol S, or the like); alkylene oxide adducts of above-noted alicyclic diols (ethylene oxide, propylene oxide, butylene oxide, or the like), and alkylene oxide adducts of above-mentioned bisphenols (ethylene oxide, propylene oxide, butylene oxide, or the like). Preferable among these are alkylene glycols having a carbon number of 2 to 12 and alkylene oxide adducts of bisphenols, and particularly preferred are alkylene oxide adducts of bisphenols, and combinations of alkylene oxide adducts of bisphenols and alkylene glycols having a carbon number of 2 to 12. Examples of trihydric and higher polyols (TO) include trihydric- to octahydric or higher polyhydric aliphatic alcohols (glycerin, trimethylolethane, trimethylol propane, pentaerythritol, sorbitol, or the like); trihydric and higher phenols (trisphenol PA, phenol novolac, cresol novolac, or the like); and alkylene oxide adducts of trihydric and higher polyphenols.

Examples of polycarboxylic acids (PC) include dicarboxylic acids (DIC) and tri- and higher polycarboxylic acid (TC), and (DIC) alone or a mixture of (DIC) and a small amount of (TC) is preferred. Examples of dicarboxylic acids (DIC) include alkylene dicarboxylic acids (succinic acid, adipic acid, sebacic acid, or the like); alkenylene dicarboxylic acids (maleic acid, fumaric acid, or the like); and aromatic dicarboxylic acids (phthalic acid, isophthalic acid, terephthalic acid, naphthalene dicarboxylic acid, or the like). Preferable among these are alkenylene dicarboxylic acids having a carbon number of 4 to 20, and aromatic dicarboxylic acids having a carbon number of 8 to 20. Examples of tri- and higher polycarboxylic acids (TC) include aromatic polycarboxylic acids having a carbon number of 9 to 20 (trimellitic acid, pyromellitic acid, or the like). It should be noted that the polycarboxylic acid (PC) may be reacted with the polyol (PO) by using an acid anhydride or a lower alkyl ester (methyl ester, ethyl ester, isopropyl ester, or the like) of the above-described compounds.

The ratio of polyol (PO) and polycarboxylic acid (PC) is normally set to 2/1 to 1/1, preferably to 1.5/1 to 1/1, and more preferably to 1.3/1 to 1.02/1, as an equivalent ratio [OH]/[COOH] of a hydroxyl group [OH] and a carboxyl group [COOH].

Examples of polyisocyanate compounds (PIC) include aliphatic polyisocyanates (tetramethylene diisocyanate, hexamethylene diisocyanate, 2,6-diisocyanate methyl caproate, or the like); alicyclic polyisocyanates (isophorone diisocyanate, cyclohexyl methane diisocyanate, or the like); aromatic diisocyanates (tolylene diisocyanate, diphenylmethane diisocyanate, or the like); aromatic aliphatic diisocyanates ($\alpha$, $\alpha$, $\alpha'$, $\alpha'$-tetramethyl xylylene diisocyanate); isocyanates; the above-noted polyisocyanate blocked with a phenol derivative, oxime, caprolactam or the like; and combinations of two or more of these.

The ratio of the polyisocyanate compound (PIC) is normally set to 5/1 to 1/1, preferably to 4/1 to 1.2/1, and more preferably to 2.5/1 to 1.5/1, as an equivalent ratio [NCO]/[OH] of the isocyanate group [NCO] and the hydroxyl group [OH] of the polyester having a hydroxyl group. If the ratio [NCO]/[OH] is greater than 5, low temperature fixing properties degraded. If the molar ratio of [NCO] is less than 1 when a urea-modified polyester is used, the urea content contained in the ester is reduced, and the hot offset resistance is compromised.

The content of the polyisocyanate compound (PIC) components in the polyester prepolymer (A) having an isocyanate group is normally 0.5 to 40 wt %, is preferably 1 to 30 wt %, and is more preferably 2 to 20 wt %. If the content is less than 0.5 wt %, the hot offset resistance is compromised, and both the heat-resistant storage characteristics and low-temperature fixing properties become unfavorable. Conversely, if the content exceeds 40 wt %, the low-temperature fixing properties are compromised.

Normally, one or more isocyanate groups are contained in each molecule of polyester prepolymer (A) having an isocyanate group. The average number of isocyanate groups contained therein is preferably 1.5 to 3.0, and more preferably 1.8 to 2.5. If each molecule of polyester prepolymer (A) contains less than one isocyanate group, the molecular weight of the urea-modified polyester is reduced and the hot offset resistance is compromised.

Examples of amines (B) that react with polyester prepolymer (A) include diamine compounds (B1), a tri- and higher polyamine compounds (B2), aminoalcohols (B3), aminomercaptans (B4), aminoacids (B5), and amines (B6) in which the B1 to B5 amino groups are blocked.

Examples of diamine compounds (B1) include aromatic diamines (phenylene diamine, diethyl toluene diamine, 4,4'-diaminodiphenyl methane, or the like); alicyclic diamines (4,4'-diamino-3,3'-dimethyldicyclohexylmethane, diamine cyclohexane, isophorone diamine, or the like); and aliphatic diamines (ethylene diamine, tetramethylene diamine, hexamethylene diamine, or the like). Examples of the tri- and higher polyamine compounds (B2) include diethylene triamine and triethylene tetramine. Examples of aminoalcohols (B3) include ethanol amine and hydroxyethyl aniline. Examples of aminomercaptans (B4) include aminoethyl mercaptan and aminopropyl mercaptan. Examples of aminoacids (B5) include aminopropionic acid and aminocaproic acid or the like. Examples of amines (B6) in which the B1 to B5 amino groups are blocked include ketimine compounds and oxazolidine compounds that can be obtained from the above-noted B1 to B5 amines and ketones (acetone, methylethyl ketone, methylisobutyl ketone, or the like). The amines (B) are preferably B1, and a mixture of B1 and a small amount of B2.

The ratio of amines (B) is normally set to 1/2 to 2/1, preferably to 1.5/1 to 1/1.5, and even more preferably to 1.2/1 to 1/1.2, as an equivalent ratio [NCO]/[NHx] of isocyanate groups [NCO] in a polyester prepolymer (A) having isocyanate groups, and amino groups [NHx] in an amine (B). If [NCO]/[NHx] exceeds 2 or is less than ½, the molecular weight of the urea-modified polyester is reduced and the hot offset resistance is compromised.

A urethane bond may be included together with a urea bond in the urea-modified polyester. The molar ratio of the urea-bond content and the urethane bond content is normally set to 100/0 to 10/90, preferably to 80/20 to 20/80, and even more preferably to 60/40 to 30/70. If the molar ratio of the urea bond is less than 10%, the hot offset resistance is compromised.

The modified polyester (i) used in the present-embodiment is manufactured using the one-shot method or the prepolymer method. The weight-average molecular weight of the modified polyester (i) is normally 10,000 or higher, is preferably 20,000 and 10,000,000, and is more preferably 30,000 and 1,000,000. The peak molecular weight at this point is preferably 1,000 and 10,000. If the peak molecular weight is less than 1,000, the extension reaction is less likely to occur and the toner has less elasticity, and, as a result, the hot offset resistance is compromised. If the peak molecular weight is greater than 10,000, the fixing properties are reduced, and particle formation and pulverization become important manufacturing issues. The number-average molecular weight of the modified polyester (i) is not particularly limited when the unmodified polyester (ii) described below is used, and preferred is a number-average molecular weight that allows the above-described weight-average molecular weight to be easily attained. If (i) is used alone, the number-average molecular weight is normally set to 20,000 or less, is preferably set to 1,000 to 10,000, and is even more preferably set to 2,000 to 8,000. If the number-average molecular weight exceeds 20,000, the low-temperature fixing properties and the glossiness are compromised when a full color device is used.

In the crosslinking reaction and/or extension reaction of polyester prepolymer (A) and amines (B) for obtaining modified polyester (i), a reaction-terminating agent may be used as needed to adjust the molecular weight of the resulting urea-modified polyester. Examples of the reaction-terminating agent include monoamines (diethylamine, dibutylamine, butylamine, lauryl amine, or the like), and compounds (ketimine compounds) in which these are blocked.

(Unmodified Polyester)

In the present embodiment, not only can the above-described modified polyester (i) be used alone, but unmodified polyester (ii) can also be included together with the modified polyester (i) as a binder resin component. Using the unmodified polyester (ii) in combination improves the low-temperature fixing properties and glossiness when a full-color device is used, and such use more preferable than the use of the modified polyester alone. An example of (ii) includes polycondensation compounds of polyol (PO) and polycarboxylic acid (PC), which are the same as the above-described polyester components of the modified polyester (i), and the preferred materials are the same as those of the modified polyester (i). Also, the unmodified polyester (ii) may not only be polyester that is not modified, but may also be a compound modified by chemical bonding other than urea bonding, and the polyester may be modified by urethane bonding, for example. From the aspects of low-temperature fixing properties and hot offset resistance, it is preferable that at least a portion of both the modified and unmodified polyester (i) and (ii) be dissolved. Therefore, the modified and unmodified polyester (i) and (ii) preferably have similar polyester compositions. The weight ratio of the modified polyester (i) and the unmodified polyester (ii) when unmodified polyester (ii) is included is normally set to 5/95 to 80/20, is preferably set to 5/95 to 30/70, is more preferably set to 5/95 to 25/75, and is particularly preferably set to 7/93 to 20/80. If the weight ratio of the modified polyester (i) is less than 5%, the hot offset resistance is compromised, and the heat-resistant storage characteristics and the low-temperature fixing properties become unfavorable.

The peak molecular weight of the unmodified polyester (ii) is normally between 1,000 and 10,000, is preferably 2,000 and 8,000, and is more preferably 2,000 and 5,000. When this peak molecular weight is below 1,000, the heat-resistant storage characteristics are compromised. Conversely, if the peak molecular weight is greater than 10,000, the low-temperature fixing properties are compromised. Also, the unmodified polyester (ii) has a hydroxyl value of 5 or higher, more preferably has hydroxyl value of 10 to 120, and particularly preferred is a hydroxyl value of 20 to 80. If the hydroxyl value of less than five, the unmodified polyester (ii) is not preferred in that both the heat-resistant storage characteristics and the low-temperature fixing properties are unfavorable. The acid value of the unmodified polyester (ii) is preferably 1 to 5, and is more preferably 2 to 4. Since a highly acidic wax is used, the binder is easily matched to a toner used in a binary developer because the low acid value binder is linked to charging and high volume resistance.

The glass transition point (Tg) of the binder resin is normally set to 35 to 70 C, and is preferably set to 55 to 65° C. If the glass transition point is less than 35° C., the heat-resistant storage characteristics are compromised. Conversely, if the glass transition temperature is greater than 70° C., the low-temperature fixing properties become inadequate. Since urea-modified polyester tend to be present on the surfaces of the resulting particulate toner matrix, the toner of the present invention tends to show adequate heat-resistant storage characteristics in comparison with known polyester toners, even if the glass transition point is low.

(Colorant)

All known dyes and pigments are may be used as a colorant, and examples that may be used include carbon black, nigrosin dye, iron black, naphthol yellow-S, Hansa yellow (10G, 5G, and G), cadmium yellow, yellow iron oxide, ocher, chrome yellow, titanium yellow, polyazo yellow, oil yellow, Hansa yellow (GR, A, RN, and R), pigment yellow L, benzidine yellow (G, GR), permanent yellow (NCG), vulcan fast yellow (5G, R), tartrazine lake, quinoline yellow lake, anthrazane yellow BGL, isoindolinone yellow, red iron oxide, red lead, lead vermilion, cadmium red, cadmium mercury red, antimony vermilion, permanent red 4R, para red, fire red, para-chloro-ortho-nitroaniline red, lithol fast scarlet G, brilliant fast scarlet, brilliant carmine BS, permanent red (F2R, F4R, FRL, FRLL, and F4RH), fast scarlet VD, vulcan fast rubine B, brilliant scarlet G, lithol rubine GX, permanent red F5R, brilliant carmine 6B, pigment scarlet 3B, bordeaux 5B, toluidine maroon, permanent bordeaux F2K, helio bordeaux BL, bordeaux 10B, BON maroon light, BON maroon medium, eosine lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, nonmetallic phthalocyanine blue, phthalocyanine blue, fast sky blue, indanthrene blue (RS, BC), indigo, ultramarine blue, Prussian blue, anthraquinone blue, fast violet B, methyl violet lake, cobalt violet, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc oxide, lithopone, and mixtures thereof. The content of the colorant is normally 1 to 15 wt % and is preferably 3 to 10 wt %.

A colorant may be used as a master batch combined with resin. Examples of the binder resin used in manufacturing the master batch or mixed with the master batch include polystyrene, poly-p-chlorostyrene, polyvinyl toluene and other styrenes, and substitution polymers thereof, or copolymers of the above-mentioned compounds and vinyl compounds, polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylate resin, rosin, modified rosin, terpene resin, aliphatic or alicyclic hydrocarbon resin, aromatic petroleum resin, chlorinated paraffin, and paraffin wax. These materials may be used alone or in combination.

(Charge Control Agent)

Known charge control agents may be used as the charge control agent. Examples of the charge control agent that may be used include nigrosin dye, triphenyl methane dye, chrome-containing metal complex dye, molybdate-chelated pigment, rhodamine dye, alkoxy amine, quaternary ammonium salts (including fluoride-modified quaternary ammonium salts), alkylamides, phosphorous alone or in a compound, tungsten alone or in a compound, fluorinated active agent, metal salicylate, and salicylate derivative metal salts. Specific examples of the charge control agent include Bontron 03 of nigrosin dye, Bontron P-51 of quaternary ammonium salt, Bontron S-34 of metal-containing azo dye, oxynaphthoate metal complex E-82, salicylate metal complex E-84, phenolic condensate E-89 (each manufactured by Orient Chemical Industries, Ltd.), TP-302 and TP-415 of quaternary ammonium salt molybdenum complex (manufactured by Hodogaya Chemical Co., Ltd.), Copy Charge PSY VP2038 of quaternary ammonium salt, Copy Blue PR of a triphenyl methane derivative, Copy Charge NEG VP2036 and Copy Charge NX VP434 of quaternary ammonium salt (each manufactured by Hoechst Co., Ltd.), LRA-901, LR-147, which is a boron complex (each manufactured by Nihon Carlit Co., Ltd.), copper phthalocyanine, perylene, quinacridone, azo pigment, and a polymer compound having a functional group such as a sulfonic acid group, a carboxyl group and a quaternary ammonium salt. Among these, materials that can impart a negative polarity to the toner are preferably used.

The amount of charge control agent to be used is determined by the type of binder resin, the presence of additives used as needed, and the toner manufacturing method including a dispersion method, and cannot be uniquely determined. However, the amount of charge control agent normally used is in a range of 0.1 to 10 parts by weight with respect to 100 parts by weight of the binder resin. A range of 0.2 to 5 is preferred. If the parts by weight exceed 10, the toner is excessively charged, the effect of the charge control agent is reduced, the electrostatic suction force with a developing roller increases, the fluidity of the developer is reduced, and the image density decreases.

(Release Agent)

Waxes with a low melting point of 50 to 120° C. work more effectively as release agents between the fixing roller and the toner boundary when prepared as dispersions in a binder resin, whereby a marked effect is obtained for high-temperature offset without applying a release agent such as oil to the fixing roller. Examples of the components of such waxes include carnauba, cotton wax, wood wax, rice wax, and other plant waxes; beeswax, lanolin, and other animal waxes; ozokerite, sericin, and other mineral waxes; and paraffin wax, microcrystalline and petrolatum, and other petroleum waxes. In addition to these natural waxes, other examples that may be used include Fischer-Tropsch wax, polyethylene wax, and other synthetic hydrocarbon waxes; and ester, ketone, ether, and other synthetic waxes. It is also possible to use 12-hydroxystearate amide, amide stearate, imide phthalate anhydride, chlorinated hydrocarbon, and other aliphatic amides; poly-n-stearyl methacrylate, poly-n-lauryl methacrylate, and other homopolymers or copolymers of polyacrylate (copolymer of n-stearyl acrylate and ethyl methacrylate, for example), which are crystalline polymer resins with a low molecular weight; and crystalline polymers or the like having a long alkyl group on the side chain.

The charge control agent and release agent may be melted and mixed together with the master batch and the binder resin, and may of course be added when dissolved and dispersed in an organic solvent.

(External Additives)

Inorganic fine particles are preferably used as an external additive for supporting fluidity, development characteristics, and charge characteristics of the toner particles. Such inorganic fine particles preferably have a primary particle diameter of $5\times10^{-3}$ to 2 μm, and more preferably $5\times10^{-3}$ to 0.5 μm. The specific surface area by the BET method is preferably 20 to 500 $m^2/g$. The ratio in which the inorganic fine particles are used is preferably 0.01 to 5 wt % in relation to the toner, and particularly preferred is 0.01 and 2.0 wt %.

Specific examples of the inorganic particles include silica, alumina, titanium oxide, barium titanate, magnesium titanate, calcium titanate, strontium titanate, zinc oxide, tin oxide, silica sand, clay, mica, quartzite, diatom earth, chromium oxide, cerium oxide, red iron oxide, antimony trioxide, magnesium oxide, zirconium oxide, barium sulfate, barium carbonate, calcium carbonate, silicon carbide, and silicon nitride. Among these, hydrophobic silica particles and hydrophobic titanium oxide particles are preferably jointly used as an agent to impart fluidity. In particular, when particles with an average diameter of no more than $5\times10^{-2}$ μm are agitated, the electrostatic force and van der Waals force relative to toner particles are considerably improved, and, as a result, it is possible to obtain a firefly-free good image quality without the fluidity accelerator desorbing from the toner particles, and the amount of transfer residual toner can be reduced even if such external additives are agitated with toner particles in a developing device in order to achieve a desired charge level.

Titanium oxide fine particles have high environmental stability and stable image density but insufficient charging startup characteristics, and, as a result, if more fine titanium oxide particles are present than silica fine particles, this adverse effect may become more influential. However, if the added amount of hydrophobic silica particles and hydrophobic titanium oxide particles is in a range of 0.3 to 1.5 wt %, the desired charge startup characteristics are obtained without significant compromise thereto. In other words, even if an image is repeatedly copied, stable image quality can be attained.

Described next is the toner manufacturing method. Herein described are preferred manufacturing methods, but the present invention is not limited thereby.

(Toner Manufacturing Method)

1) A colorant, an unmodified polyester, a polyester prepolymer having an isocyanate group, and a release agent are dispersed in organic solvent to produce a liquid toner material. From the aspect of easy removal after formation of the particulate toner matrix, the organic solvent is preferably volatile with a boiling point of less than 100° C. Specific examples that may be used singly or in a combination of two or more include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. Particularly preferred are toluene, xylene, and other aromatic solvents; and methylene chloride, 1,2-dichloroethane, chloroform, carbon tetrachloride, and other halogenated hydrocarbons. The amount of organic solvent used with respect to 100 parts by weight of polyester prepolymer is normally 0 to 300 parts by weight, is preferably 0 to 100 parts by weight, and is more preferably 25 to 70 parts by weight.

2) The liquid toner material is emulsified in an aqueous medium in the presence of a surfactant agent and fine resin particles. The aqueous medium may be water, or alcohol (methanol, isopropyl alcohol, ethylene glycol, or the like), dimethyl formamide, tetrahydrofuran, cellosolves (methyl cellosolve), lower ketone (acetone, methyl ethyl ketone, or the like), or another organic solvent.

The amount of aqueous medium used with respect to 100 parts by weight of the liquid toner material is normally 50 to 2,000 parts by weight, and is preferably 100 to 1,000 parts by weight. If the aqueous medium is less than 50 parts by weight, the liquid toner material is poorly dispersed, and toner particles with a prescribed diameter cannot be obtained. Conversely, if the aqueous medium exceeds 20,000 parts by weight, the process is economically inefficient.

Also, for the purpose of good dispersion in aqueous solvent, a surfactant, microparticulate resin, or another dispersion agent is added as needed. Examples of the surfactant include alkylbenzene sulfonate salts, α-olefin sulfonate salts, phosphate esters, and other anionic surfactants; alkyl amine salts, aminoalcohol fatty acid derivatives, polyamine fatty acid derivatives, imidazoline, and other amine salts; alkyl trimethyl ammonium salts, dialkyl dimethyl ammonium salts, alkyl dimethyl benzyl ammonium salts, pyridinium salts, alkyl isoquinolinium salts, benzethonium chloride, and other cationic surfactants of quaternary ammonium salts; fatty amide derivatives, polyol derivatives, and other nonionic surfactants; and alanine, dodecyl (amino ethyl) glycine, di(octyl amino ethyl)glycine, N-alkyl-N,N-dimethyl ammonium betaine, and other ampholytic surfactants.

Also, by using a surfactant having a fluoroalkyl group, the effect thereof can be attained with a very small amount. Examples of the anionic surfactant having a fluoroalkyl group that are preferably used include fluoroalkyl carboxylic acids having a carbon number of 2 to 10, metal salts thereof, disodium perfluorooctane sulfonyl glutamate, sodium 3-[ω-fluoroalkyl (C6 to C11)oxy]-1-alkyl (C3 to C4) sulfonates, sodium 3 [ω-fluoroalkanoyl (C6 to C8)oxy]-N-ethylamino]-1-propane sulfonates, fluoroalkyl (C11 to C20) carboxylic acids, metal salts thereof, perfluoroalkyl carboxylic acids (C7 to C13), metal salts thereof, perfluoroalkyl (C4 to C12) sulfonic acids, metal salts thereof, perfluorooctane sulfonic acid diethanolamide, N-propyl-N-(2-hydroxyethyl)-perfluorooctane sulfonamide, propyl trimethylammonium salts of perfluoroalkyl (C6 to C10) sulfonamides, salts of perfluoroalkyl (C6 to C10)-N-ethyl sulfonyl glycines, monoperfluoroalkyl (C6 to C16) ethyl phosphate esters, and the like.

Examples of commercially available products include Surflon S-111, S-112 and S-113 (manufactured by Asahi Glass Co., Ltd.); Florad FC-93, FC-95, FC-98, and FC-129 (manufactured by Sumitomo 3M, Ltd.); Unidyne DS-101 and DS-102 (manufactured by Daikin Industry, Ltd.); Megaface F-110, F-120, F-113, F-191, F-812, and F-833 (manufactured by Dainippon Ink and Chemicals, Inc.); Ektop EF-102, EF-103, EF-104, EF-105, EF-112, EF-123A, EF-123B, EF-306A, EF-501, EF-201, and EF-204 (manufactured by Tohkem Products); and Ftergent F-100 and F-150 (manufactured by Neos).

Examples of the cationic surfactant include aliphatic primary, secondary, or tertiary amino acids having fluoroalkyl groups; propyl trimethylammonium salts of perfluoroalkyl (C6 to C10) sulfonamide, benzalkonium salts, benzethonium chloride, pyridinium salts, imidazolinium salts, and other aliphatic quaternary ammonium salts. Examples of commercially available products include Surflon S-121 (manufactured by Asahi Glass), Florad FC-135 (manufactured by Sumitomo 3M.), Unidyne DS-202 (manufactured by Daikin Industries), Megaface F-150, F-824 (manufactured by Dainippon Ink and Chemicals), Ektop EF-132 (manufactured by Tohkem), and Ftergent F-300 (manufactured by Neos).

Any resin can be used as long as the resin can form an aqueous dispersion, and thermoplastic resins and thermosetting resins may be used to obtain fine resin particles. Examples of such resins include vinyl resins, polyurethane resins, epoxy resins, polyester resins, polyamide resins, polyimide resins, silicon resins, phenol resins, melamine resins, urea resins, aniline resins, ionomer resins, and polycarbonate resins. The resin may also be one in which two or more of the above resins are jointly used.

Preferable among these from the aspect of ease in obtaining an aqueous dispersion of fine spherical resin particles are vinyl resins, polyurethane resins, epoxy resins, polyester resins, and combinations thereof. Examples of vinyl resins include polymers in which a vinyl monomer has been polymerized or copolymerized, specific examples of which include resins composed of styrene-(meth)acrylic acid ester copolymer, styrene-butadiene copolymer, (meth)acrylic acid-acrylic acid ester polymer, styrene-acrylonitrile copolymer, styrene-maleic anhydride copolymer, and styrene-(meth)acrylic acid copolymer. The average particle diameter of the fine resin particles is 5 to 200 nm, and is preferably 20 to 30 nm.

Also, an inorganic dispersant such as tricalcium phosphate, calcium carbonate, titanium oxide, colloidal silica, or hydroxyl apatite may be used.

Dispersion droplets can be stabilized with a polymer protective colloid as a dispersant that can be jointly used with the above-described fine resin particles and inorganic compound dispersant. Examples include acrylic acid, methacrylic acid, α-cyanoacrylic acid, α-cyanomethacrylic acid, itaconic acid, crotonic acid, fumaric acid, maleic acid, maleic anhydride, and other acids; or (meth)acrylic monomers containing a hydroxyl group, examples of which include β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic acid ester, diethylene glycol monomethacrylic acid ester, glycerin monoacrylic acid ester, glycerin monometharylic acid ester, N-methylolacrylamide, and N-methylolmethacrylamide; vinyl alcohol, or ethers with vinyl alcohol, examples of which include vinyl methyl ether, vinyl ethyl ether, and vinyl propyl ether; esters of vinyl alcohol and compounds having a carboxylic group, examples of which include vinyl acetate, vinyl propionate, and vinyl lactate; acrylamide, methacrylamide, diacetone acrylamide or methylol compounds thereof; acid chlorides, examples of which include chloride acrylate and chloride methacrylate; vinylpyridine, vinylpyrrolidone, vinylimidazole, ethyleneimine, and other nitrogen-containing compounds; homopolymers or co-polymers having heterocycles thereof; polyoxyethylene, polyoxypropylene, polyoxyethylene alkylamines, polyoxypropylene alkylamines, polyoxyethylene alkylamides, polyoxypropylene alkylamides, polyoxyethylene nonylphenyl ether, polyoxyethylene lauryl phenyl ether, polyoxyethylene stearyl phenyl ester, polyoxyethylene nonyl phenyl ester, and other polyoxyethylenes; and methyl cellulose, hydroxyethyl cellulose, hydroxypropyl cellulose, and other celluloses.

The present invention is not limited to a particular dispersion method, but known techniques, such as low-speed shearing, high-speed shearing, friction, high-pressure jetting, and ultrasound can be used. Among these, the high-speed shearing is preferred in obtaining dispersion particles having a diameter of 2 to 20 μm. In the case that a high-speed shearing-type dispersion apparatus is used, the rotation speed is not limited, but the rotation speed is normally set to 1,000 to 30,000 rpm, and is preferably set to 5,000 to 20,000 rpm. The dispersion time is not particularly limited, but in the case of the batch method, the dispersion time is normally set to 0.1 to 5 minutes. The temperature during dispersion is normally kept to 0 to 150° C. (under pressure), and is preferably kept to 40 to 98° C.

3) During production of liquid emulsion, amines (B) are added to cause a reaction with polyester prepolymer (A) having an isocyanate group. This reaction involves crosslinking and/or extension of the molecular chain. The reaction time is selected based on the reactivity of the amines (B) with the structure of the isocyanate groups in the polyester prepolymer (A), but the reaction time is normally 10 minutes to 40 hours, and is preferably 2 to 24 hours. The reaction temperature is normally 0 to 150° C., and preferably 40 to 98° C. In addition, known catalysts may be used as needed. Specific examples thereof include dibutyl tin laurate and dioctyltin laurate.

4) After the reaction is completed, the organic solvent is removed from the emulsified dispersion body (reactant), and the resulting material is then cleaned and dried to obtain a particulate toner matrix. In order to remove the organic solvent, the entire system is gradually heated while stirred in a laminar flow, the system is then briskly agitated in a fixed temperature range, and a spindle-shaped particulate toner matrix is produced by removal of the organic solvent. Also, in the case that a material soluble in acids or alkalis, such as calcium phosphate, is used as a dispersion stabilizer, the calcium phosphate is dissolved using hydrochloric acid or another acid, and the resulting material is then washed with water so as to remove the calcium phosphate from the particulate toner matrix. Removal may also be carried out with enzyme decomposition or another operation.

5) A charge control agent is injected as required into the resulting particulate toner matrix, and silica particles, titanium oxide particles, or other inorganic particles are then externally added to obtain toner. The charge control agent is injected and the inorganic particles are externally added with a known method in which a mixer or the like is used. In accordance with the above, toner particles having a small diameter and a sharp diameter distribution can easily be obtained. Furthermore, the shape can be set to one that ranges between a true spherical shape and the shape of a rugby ball by brisk agitation in the step for removing organic solvent, and the morphology of the surface can be set to a texture between smooth and rough.

The shape of the toner according to the present embodiment is substantially a spherical shape that can be expressed by the following shape definition.

Figure 14A:
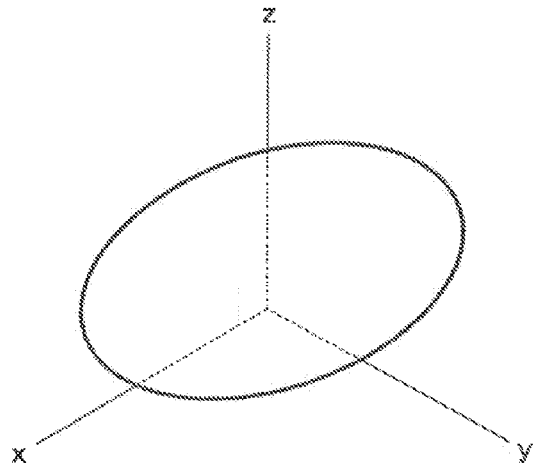
FIGS. 14A to 14C are diagrams that schematically shown the shape of the toner according to the present invention.
Figure 14B:
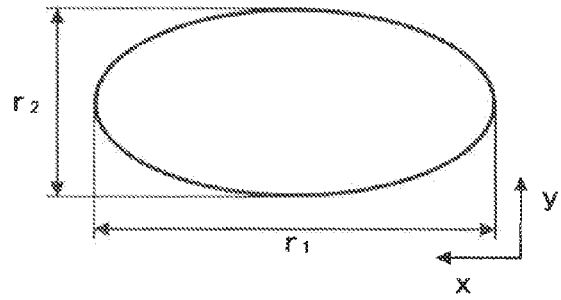
Figure 14C:
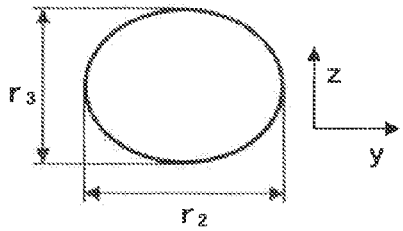

FIGS. 14A to 14C are diagrams that schematically show the shape of the toner according to the present invention. In FIGS. 14A to 14C, when the substantially spherical toner is defined by the major axis r1, minor axis r2, and thickness r3 (where r1≧r2≧r3), the toner of the present invention preferably has a shape at which the ratio of the minor axis to the major axis (r2/r1) (refer to FIG. 14(B)) is in a range of 0.5 and 1.0, and the ratio of the thickness to the minor axis (r3/r2) (refer to FIG. 14(C)) is in a range of 0.7 and 1.0. If the ratio (r2/r1) of the minor axis and the major axis is less than 0.5, the shape deviates from a true spherical shape, and, as a result, it becomes impossible to obtain high-quality images because of inferior dot reproducibility and transfer efficiency. Also, if the ratio (r3/r2) of the thickness and the minor axis is less than 0.7, the shape approaches a flat shape, and, as a result, it is impossible to achieve a high transfer rate as can be attained with a spherical toner particle. In particular, if the ratio (r3/r2) of the thickness and the minor axis is 1.0, the toner particles become rotating bodies whose major axis is the axis of rotation, and the toner fluidity can be improve as a result.

It should be noted that the lengths r1, r2, and r3 are measured by taking pictures from different viewing angles through a scanning electron microscope (SEM).

The toner manufactured in the manner described above can be used as a non-magnetic toner or a single-component magnetic toner obtained without the use of a magnetic carrier.

Also, if the manufactured toner is used in a two-component developer, the toner may be mixed with a magnetic carrier. Such a magnetic carrier may be iron, magnetite, Mn, Zn, Cu, or another ferrite containing a divalent metal, and preferably has a volume-average particle diameter of 20 to 100 μm. If the average particle diameter is less than 20 μm, carrier deposits tend to accumulate on the photoreceptor 1 during development, and if the average diameter exceeds 100 μm, the mixture with the toner is inadequate, and the toner is insufficiently charged, resulting in a condition in which insufficient charging and other drawbacks tend to occur during continuous use. Also, zinc-containing Cu ferrite is preferred because of its high saturation magnetization, and the ferrite may be suitably selected in accordance with the process of the image-forming apparatus 100. The resin for covering the magnetic carrier is not particularly limited, and examples thereof include silicone resin, styrene-acrylic resin, fluorine-containing resin, and olefin resins. The manufacturing method may be one in which the coating resin is dissolved in a solvent, and the resulting solution sprayed in a fluidized bed to coat the resin on a core, or the resin particles are electrostatically deposited on the nuclear particles, and the resulting particles are then thermally fused to form a cover. The thickness of the covered resin is normally 0.05 to 10 μm, and is preferably 0.3 to 4 μm.

In accordance with the embodiment described above, it is possible to provide a charged device in which adequate charging performance can be obtained from the start of service, and that can maintain the performance over a long period of time. It is also possible to provide a charged device that keeps the surface of the charged roller clean and achieves adequate charging performance in any service environment in which the image-forming device is placed. It is furthermore possible to provide a process cartridge and an image-forming device in which the charged device can be mounted and that can form excellent images.

Third Embodiment

Described below is an embodiment in which the present invention has been applied to a color laser printer (hereinafter simply referred to as "printer"), which is an image-forming device.

Figure 15:
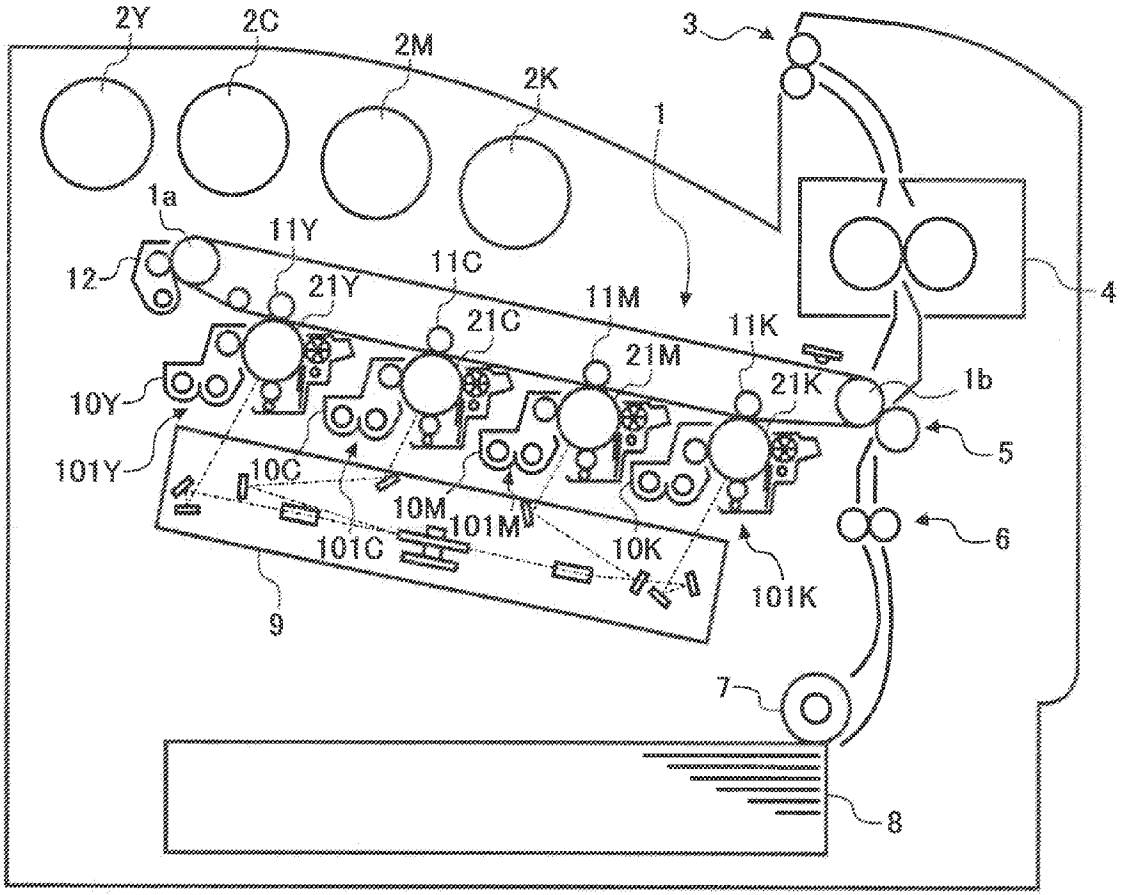
FIG. 15 is a diagram of the general configuration of the printer according to the third embodiment of the present invention.

FIG. 15 is a diagram of the general configuration of the printer according to the present embodiment. The printer is configured with a tandem image-forming unit in which four image-forming devices for the colors yellow, cyan, magenta, and black are aligned in a lateral arrangement. In the tandem image-forming units, the image-forming devices 101Y, 101C, 101M, and 101K, which are each toner image-forming devices, are disposed in order from the left side of the diagram. Here, each of the subscripts of the key symbols Y, C, M, and K represent members for yellow, magenta, cyan, and black, respectively. In the tandem image-forming device unit, the image-forming devices 101Y, C, M, and K are provided with a charged device, developing devices 10Y, C, M, and K, a photoreceptor cleaning device, and other components disposed around the photoreceptors 21Y, C, M, and K in the form of a drum as a latent image carriers. Toner bottles 2Y, C, M, and K filled with the colors yellow, cyan, magenta, and black, respectively, are disposed in the upper portion of the printer. A prescribed amount of the color toners is fed from the toner bottles 2Y, C, M, and K to the color developing devices 10Y, C, M, and K by way of a conveyance pathway (not shown).

An optical writing unit 9 is provided as a latent image forming device below the tandem image-forming unit. The optical writing device 9 is provided with a light source, a polygon mirror, an f-θ lens, a reflective mirror, and other components, and is configured so as to direct laser light while scanning the laser light over the surface of the photoreceptors 1 on the basis of the image data.

An intermediate transfer belt 1 in the form of an endless belt is provided as an intermediate transfer body to a location immediately above the tandem image-forming unit. The intermediate transfer belt 1 is suspended around support rollers 1*a* and 1*b*, and a drive motor (not shown) is linked as a drive source to the shaft of the drive roller 1*a*, which is one of the support rollers used as the drive roller. When the drive roller is driven, the intermediate transfer belt 1 rotatably moves in the counterclockwise direction in the diagram, and the drivable support roller 1*b* rotates. Provided inside the intermediate transfer belt 1 are primary transfer devices 11Y, C, M, and K for transferring onto the intermediate transfer belt 1 a toner image formed on the photoreceptors 21Y, C, M, and K.

Also, a secondary transfer roller 5 is provided as a secondary transfer device downstream in the driving direction of the intermediate transfer belt 1 from the primary transfer devices 11Y, C, M, and K. The support roller 1*b* is disposed opposite from the secondary roller 5 so as to sandwich the intermediate transfer belt 1, and functions as a pressing member. Also provided are a paper supply cassette 8, a paper supply roller 7, a resist roller 6, and other components. Furthermore, a paper discharge roller 3 and a fixing device 4 for fixing the image on the recording sheet S are provided downstream from the secondary roller 5 in the traveling direction of the recording sheet S on which a toner image has been transferred by the secondary transfer roller 5.

The printer operation is described next.

The photoreceptors 21Y, C, M, and K rotate in the image-forming devices, and together with the rotation of the photoreceptors 21Y, C, M, and K, the surfaces of the photoreceptors 21Y, C, M, and K are first uniformly charged by the charged devices 17Y, C, M, and K. Next, writing light produced by a laser is directed from the optical writing unit 9 on the basis of an image pattern to form an electrostatic latent image on the photoreceptors 21Y, C, M, and K. Yellow, cyan, magenta, and black monochrome images are thereafter formed on the photoreceptors 21Y, C, M, and K, respectively, by depositing toner with the developing devices 10Y, C, M, and K to change the electrostatic latent image into a visible image. The drive roller 1*a* is rotatably driven by a drive motor (not shown), the other driven roller 1*b* and secondary transfer roller 5 are rotatably driven, the intermediate transfer belt 1 is rotatably driven, and the visible image is sequentially transferred to the intermediate transfer belt 1 by the primary transfer devices 11Y, C, M, and K. A composite color image is thereby formed on the intermediate transfer belt 1. Residual toner is thereafter removed from the surface of the photoreceptors 21Y, C, M, and K by the photoreceptor cleaning device to clean and prepare for the next cycle of image formation.

In conjunction with the timing of the above-described image formation, the front edge of the recording sheet S is drawn out from the paper supply cassette 8 by the paper supply roller 7, conveyed to the resist roller 6, and temporarily brought to a stop. In proper timing with the image-forming operation, the sheet is conveyed between the secondary roller 5 and the intermediate transfer belt 1. Here, the intermediate transfer belt 1 and secondary roller 5 sandwich the recording sheet S to form a second transfer nip, and the toner image on the intermediate transfer belt 1 (*5) is secondarily transferred onto the recording sheet S at the secondary transfer roller 5.

The recording sheet S with the transferred image is sent to the fixing device 4, heat and pressure are applied using the fixing device to fix the transferred image, and the sheet is discharged out of the machine. The residual toner remaining on the intermediate transfer belt 1 after image formation is removed from the intermediate transfer belt 1 with the transferred image by the intermediate transfer body cleaning device 12 to prepare for the next cycle of image formation by the tandem image-forming unit.

It should be noted that the toner image-forming units 101Y, C, M, and K of the above-described colors are integrally formed, and the detachable process cartridges can be detached from the main body. The integral process cartridges can be pulled out from the diagrammed side of the printer main body along guide rails (not shown) fixed to the printer main body. Also, the toner image-forming unit can be loaded into a prescribed position by pushing the process cartridge-into the printer main body.

Figure 16:
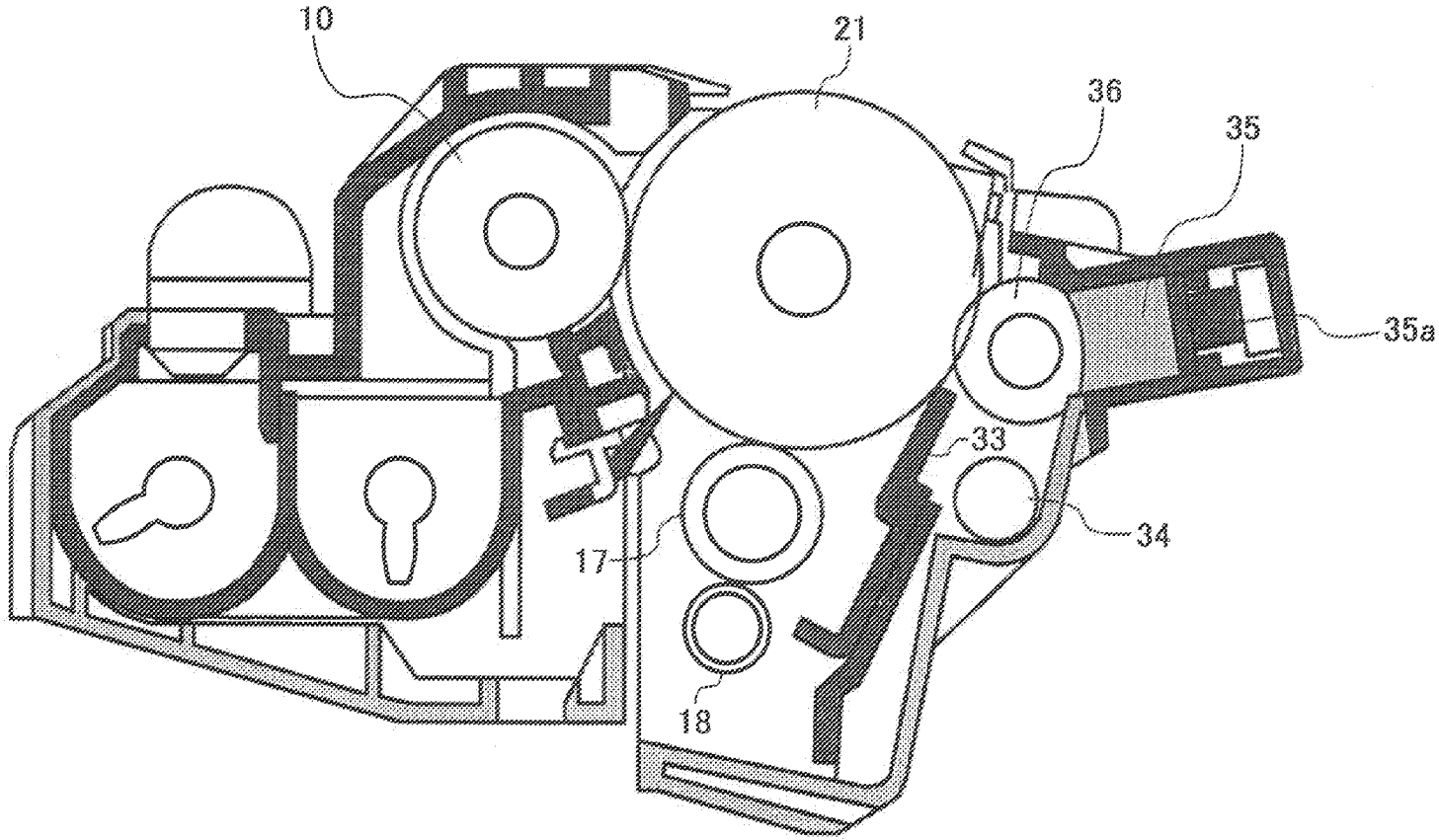
FIG. 16 is a diagram of the general configuration of the process cartridge constituting the toner image-forming unit of the printer.

Here, the process cartridges of the toner image-forming units 101Y, C, M, and K are each configured in the same fashion and made to perform the same operations. Therefore, the subscripts Y, C, M, K of the key symbols are omitted, and the process cartridges of the toner image-forming units are described in detail. FIG. 16 shows an enlarged view of the general configuration of the process cartridge of the toner image-forming unit 1010. In FIG. 16, disposed in order around the photoreceptor 21 that rotates in the clockwise direction in the diagram are a charged roller 17 as a charged device, a developing device 10, a fur brush 36 as a photoreceptor body cleaning device, a cleaning blade 33, and other components. Thus, the charged roller 17 is disposed below the photoreceptor 21 in the perpendicular direction in the printer of the present embodiment. Also provided below the charged roller 17 is a cleaning roller 18 as a charged cleaning roller that rotatably makes contact and cleans the surface of the charged roller 17 in conjunction with the rotation thereof. A waste toner conveyance coil 34 is also provided for emptying the process cartridge of the waste toner taken from the fur brush 36, cleaning blade 33, and photoreceptor 21.

Figure 17A:
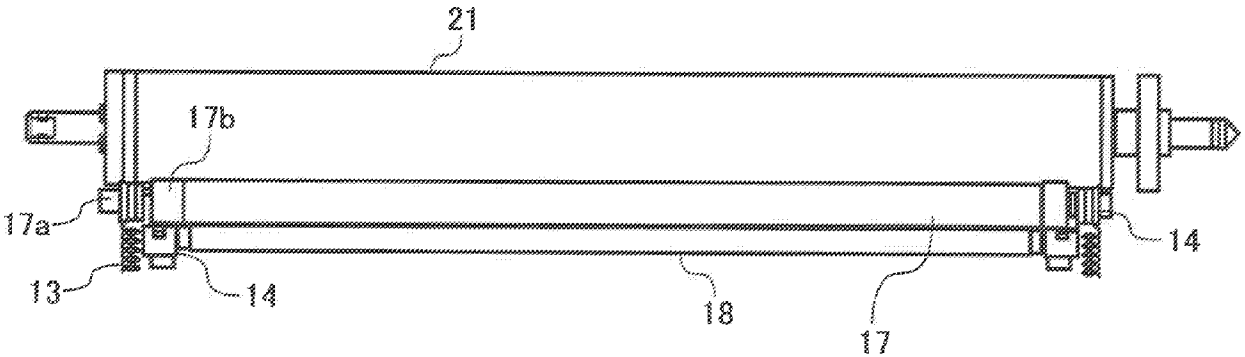
FIG. 17A is a front view of the photoreceptor, charged roller, and cleaner roller.
Figure 17B:
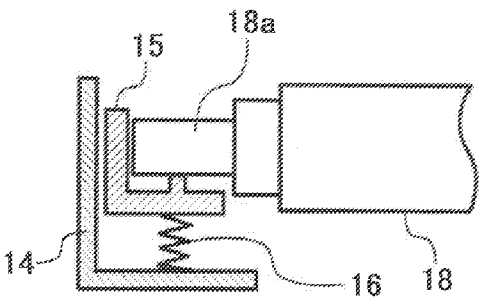
FIG. 17B is an enlarged cross-sectional diagram of the bearing portion of the cleaner roller.

FIG. 17A is a front view of the photoreceptor 21, the charged roller 17, and the cleaner roller 18. FIG. 17B is an enlarged cross-sectional diagram of the bearing portion of the cleaner roller 18. The photoreceptor 21 is an aluminum tube with a diameter of 30 mm coated with an organic photosensitive layer. A flange gear 21*a* is provided to a side end portion of the aluminum original tube of the photoreceptor 21. The flange gear meshes with the photoreceptor body drive gear (not shown), and rotates in the prescribed direction. The photoreceptor 21 and charged roller 17 make contact via a gap roller 17*b* disposed at both ends of the charged roller 17 while maintaining a small gap of 10 to 70 μm.

The charged roller 17 has a resin layer 17*b* composed of ABS/polyether ester amide or another electroconductive material formed on the rotating shaft 17*a*. The electrical resistance of the resin layer is $10^4$ to $10^6$ [Ω·cm]. Also, a surface layer composed of ceramic/carbon or the like may be provided to the resin layer. An AC voltage of 1.8 to 2.5 KVp-p is superimposed on a DC voltage of −500 V to −700 V, for example, is applied from a power source (not shown), to the rotating shaft 17*a* of the charged roller 17 to uniformly charge the photoreceptor 21.

The cleaner roller 18 is composed of melamine resin foam that has been compression molded 20 to 50% on the rotating shaft 18*a*. The reason for such compression molding is that nonuniform cleaning characteristics result from the large cells in the original state of the material, and this problem is therefore solved in order to make the cleaning characteristics uniform. In addition to this, a material with electrostatically embedded segmented microfilaments may be used as the cleaner roller 18. It should be noted that the average diameter of the microfilaments that is used is 0.05 to 20 μm, and the fiber length is 0.5 to 2 mm. A cleaner roller with a total length of 227 mm and an outside diameter of 8 mm is used.

The fur brush 36 uses an electroconductive acrylic resin (manufactured by Toray Industries under the trade name SA-7, for example). Here, a fiber thickness of 6.25 deniers and a density of 30,000 fibers are used. The direction of rotation is the counterclockwise direction in the diagram, the outside diameter is 12 mm, and with a bite of 1 mm in relation to the photoreceptor, the photoreceptor linear velocity ratio at the outside diameter of the bite is set to 1:1.

A cleaning blade 33 composed of polyurethane rubber with a rubber hardness of 65 to 75° is used, the projection length is 7 to 9 mm, the initial contact angle is 15 to 20°, and the contact pressure is 0.18 to 0.3 N/cm.

A lubricant is applied to the surface of the photoreceptor 21 in order to protect the surface of the photoreceptor 21. When a voltage superimposed with an AC voltage is applied on the photoreceptor by the charged device as in the present embodiment, the photoreceptor 21 tends to experience filming due to the AC hazard, and the application of a lubricant is therefore required. Zinc stearate was used as the lubricant. A solid bar 15 of zinc stearate is pressed in two locations to the fur brush 36 on one side with a pressure of 200 to 800 mN by way of a compression spring 35*a*. Zinc stearate is thereby gradually applied to the surface of the photoreceptor 21 by way of the fur brush 36.

Described next is the pressure mechanism of the charged roller and cleaner roller, which are characteristic components of the present embodiment.

Figure 18:
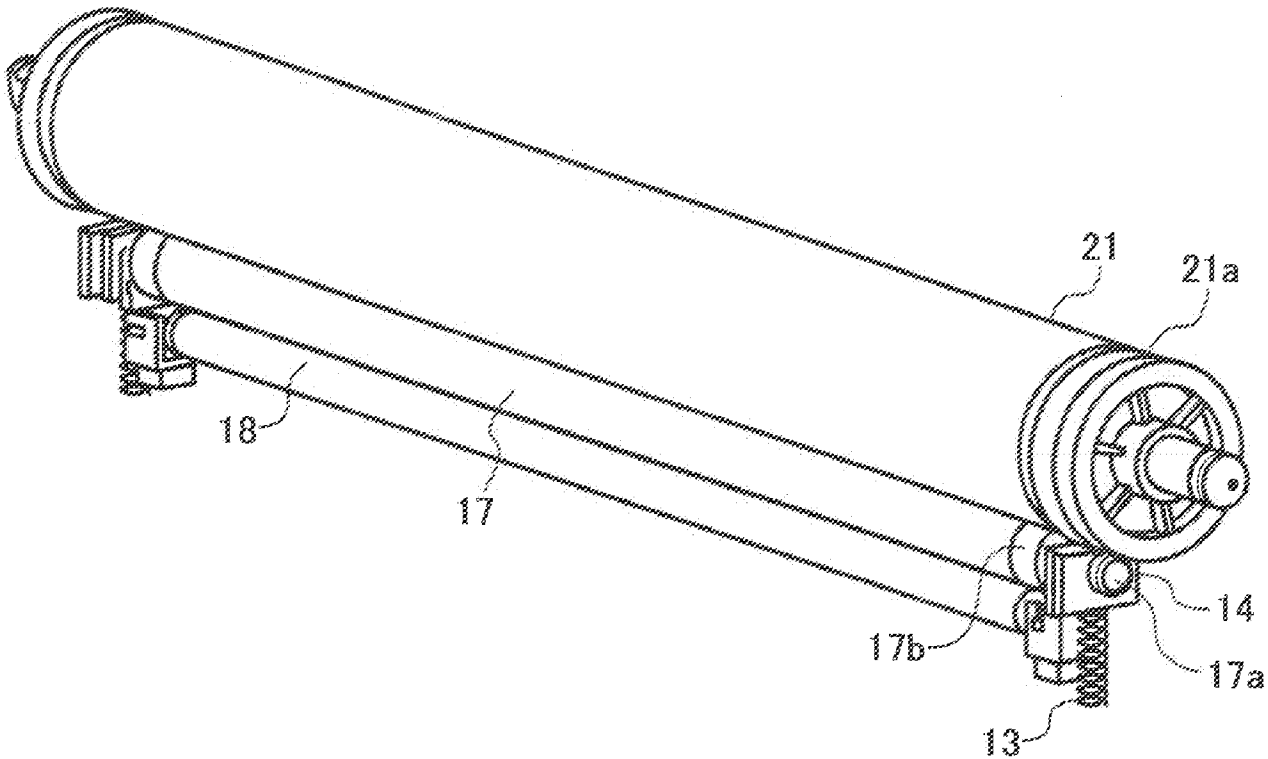
FIG. 18 is a perspective view showing the general configuration of the photoreceptor, charged roller, and cleaner roller.

FIG. 18 is a perspective view showing the general configuration of the photoreceptor 21, the charged roller 17, and the cleaner roller 18. The bearing 14 of the charged roller 17 rotatably supports the rotating shaft 17*a* of the charged roller, is guided by the guide of the frame (not shown), and is configured to be pressed by the spring 13 for pressing the bearing 14 and to freely slide in the vertical direction. The charged roller 17 is pressed into contact with the photoreceptor 21. The pressure force on one side is 5 to 6 N. It should be noted that a gap roller 17*b* with a large outside diameter that is 30 to 60 μm greater than the outside diameter of the charged roller 17 is coaxially attached to both ends of the charged roller 17, and the photoreceptor 21 and charged roller 17 thereby maintain a very small gap of 10 to 70 μm.

Figure 19:
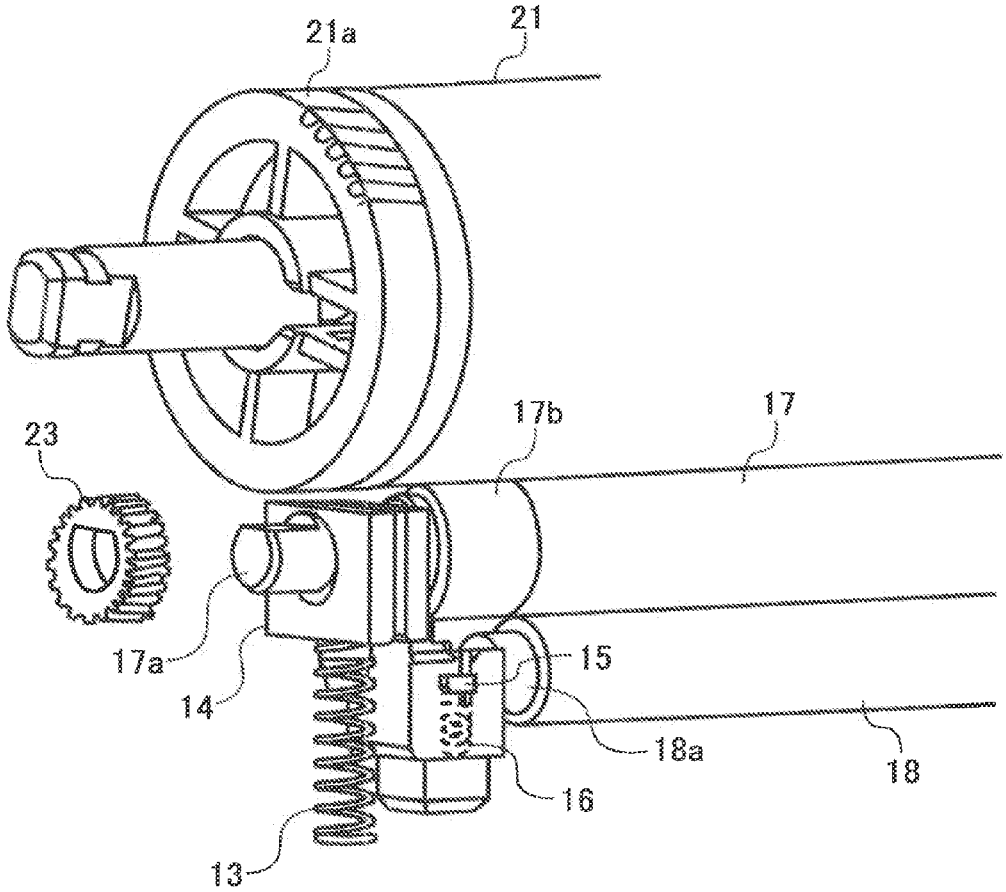
FIG. 19 is an enlarged perspective view of the bearing portion of the photoreceptor, charged roller, and cleaner roller.

FIG. 19 is an enlarged perspective view of the bearing portion of the photoreceptor 21, the charged roller 17, and the cleaner roller 18. The rotating shaft 17*a* of the charged roller is rotatably supported by the bearing 14. The rotating shaft 17*a* of the charged roller receives drive force from the gear 23 by way the flange 21*a* of the photoreceptor 21, and the photoreceptor 21 rotates at a constant velocity. The rotating shaft 18*a* of the cleaner roller is rotatably supported by the bearing 15. The bearing 14 of the rotating shaft 17*a* of the charged roller extends downward in the perpendicular direction, and has a function as a retainer for the cleaner roller bearing retainer that supports the bearing 15 of the rotating shaft 18*a* of the cleaner roller. That is to say, the cleaner roller bearing retainer for supporting the bearing 15 of the rotating shaft 18*a* of the cleaner roller is integrally formed with the bearing 14 of the rotating shaft 17*a* of the charged roller.

Figure 20:
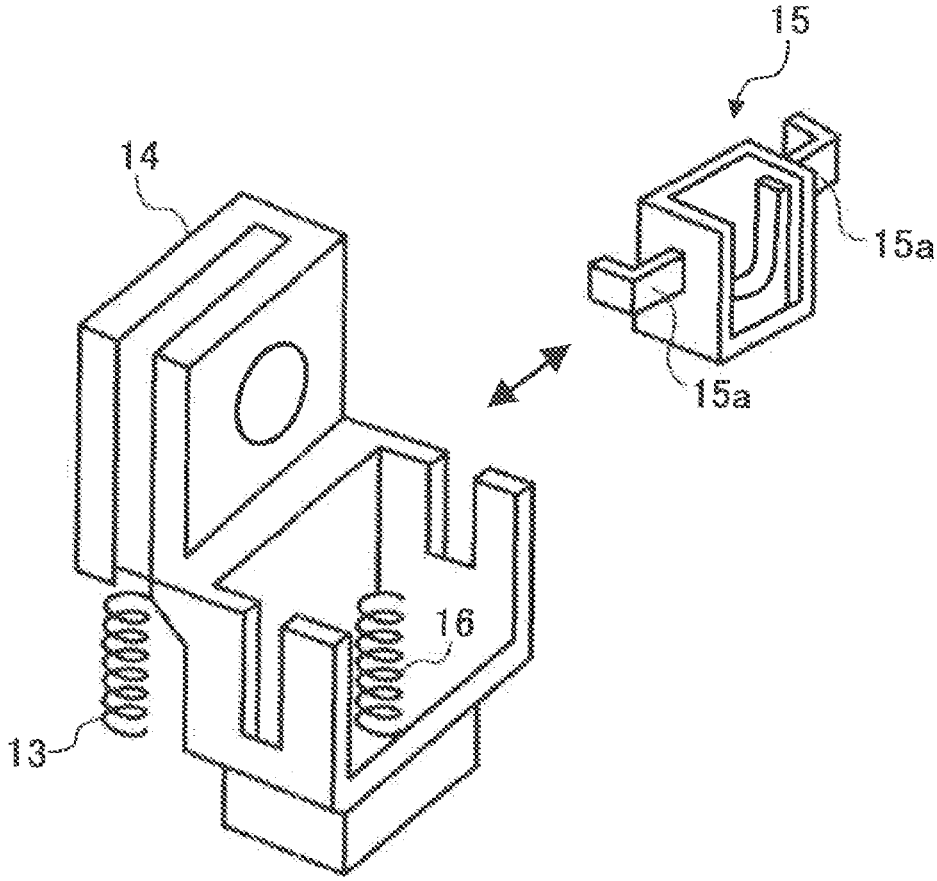
FIG. 20 is a diagram for describing the configuration of the rotating shaft bearing of the charged roller, the rotating shaft bearing of the cleaner roller, and the springs.

FIG. 20 is a diagram for describing the configuration of the bearing 14 of the rotating shaft 17*a* of the charged roller, the bearing 15 of rotating shaft 18*a* of the cleaner roller, and the spring 16. The bearing 15 of the rotating shaft 18*a* of the cleaner roller is held by an insert formed by two ribs 15*a* that protrude toward the bearing 14, and the spring 16 serving as an elastic member is interposed between the bearings 14 and 15. For this reason, the bearing 15 of the rotating shaft 18*a* of the cleaner roller can slide in the vertical direction with respect to the bearing 14 of the shaft 17*a* of the charged roller. The bearing retainer of the cleaner roller of bearing 14 presses with the spring 16 the bearing 15 in which the rotating shaft 18*a* of the cleaner roller is rotatably supported with a one-sided force of 0.6 N, and the force with which the cleaner roller 18 is pressed against the charged roller 17 is set to be 15 to 50 mN/cm (excluding the weight of the cleaner roller 18 itself). If the pressing force is greater than 50 mN/cm, the sliding load of the bearing 15 of the rotating shaft 18*a* of the cleaner roller increases and linked rotation becomes difficult. If the pressing force is less than 15 mN/cm, the evenness of the surface of the cleaner roller 18 has an effect that results in nonuniformity, and the cleaning characteristics are reduced. If the contact pressure is excessively low and linked rotation becomes difficult, the fine toner particles create filming on the surface of the charged roller 17 as a result.

The bearing surface of the bearing 15 has ribs with a width of 0.8 to 1.5 mm and accepts the semicircular surface with a diameter of 4 mm of the rotating shaft 18*a*. If the contact width is large, the sliding resistance of the rotating shaft 18*a* increases, the friction coefficient μ of the charged roller 17 and the cleaner roller 18 tends to be reduced, and when carrier, toner, and other foreign matter enters into the bearings 14 and 15, locking tends to occur. In view of the above, the present inventors found as a result of investigation that a shaft contact surface area of 3 to 20 $mm^2$ on one side is favorable for the rotating shaft 18*a* and the bearing 15. When the surface area is greater than this, the resistance of linked rotation is great, and a low surface area is disadvantageous in terms of abrasion.

Described next is the material of the surface portion of the cleaner roller 18.

Figure 21:
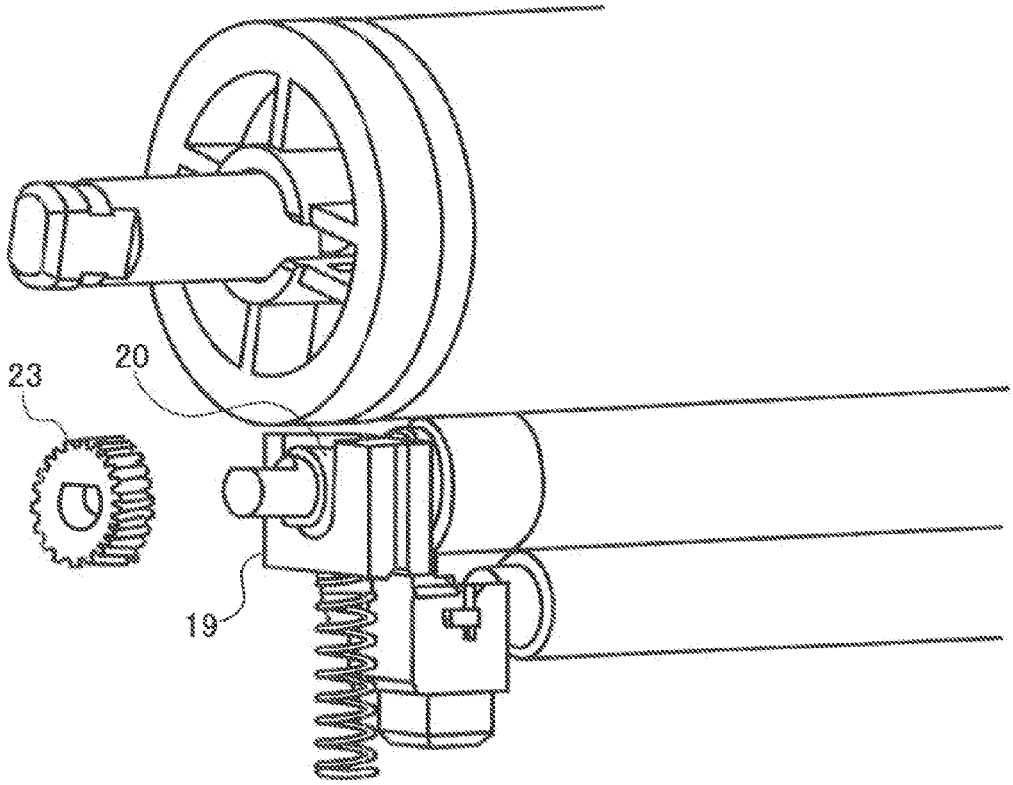
FIG. 21 is a perspective diagram of a configuration in which the rotating shaft of the charged roller is driven via a collar.
Figure 22:
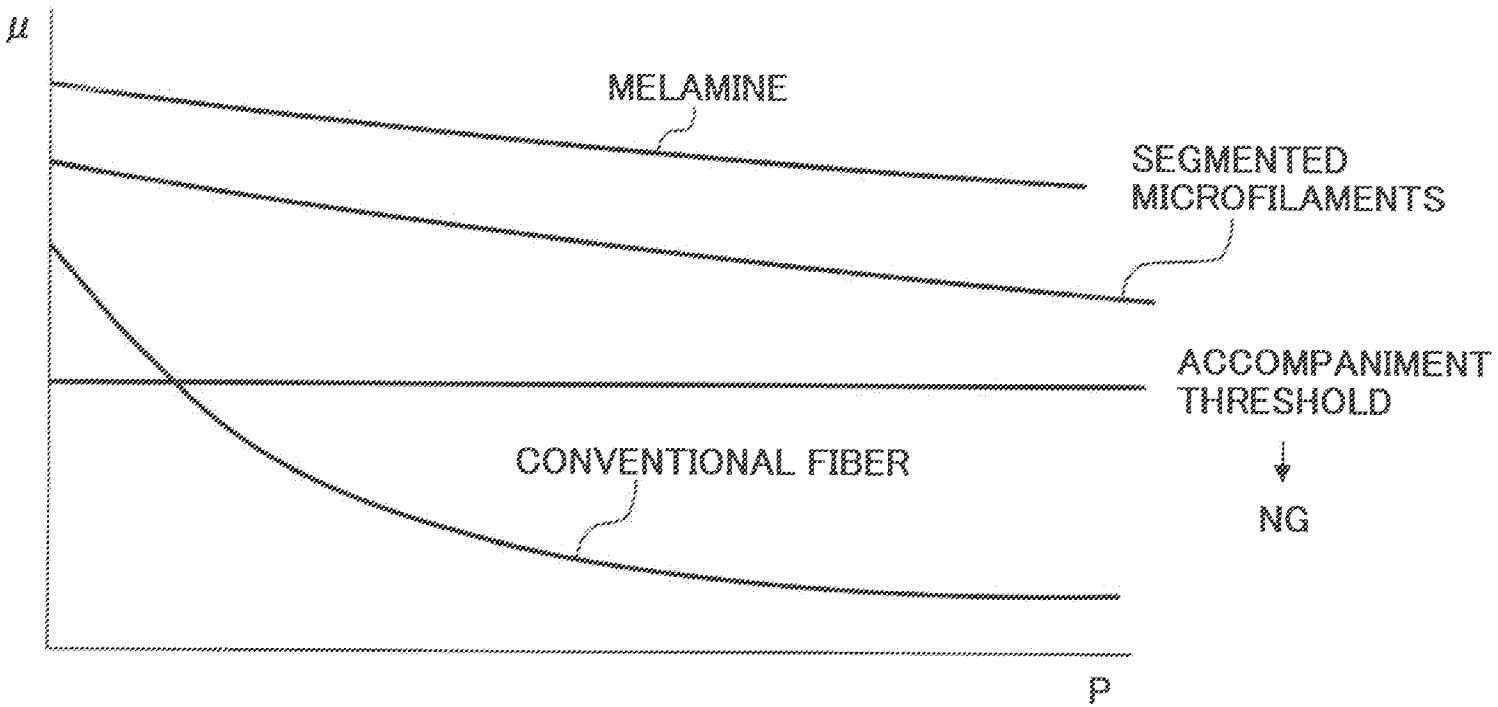
FIG. 22 is a diagram for showing the relationship between the contact pressure P between the solid bar of zinc stearate and fur brush, and the friction coefficient μ between the charged roller and cleaner roller.

As described above, when a lubricant is applied to the surface of the photoreceptor 21, it may occur that the lubricant will move to the charged roller 17 and the cleaner roller 18 over time, and reduce the friction coefficient between the charged roller 17 and cleaner roller 18. FIG. 22 shows the relationship between the contact pressure P, wherein P is the contact pressure between the solid bar of zinc stearate 35 and fur brush 36, and the friction coefficient μ between the charged roller 17 and cleaner roller 18 after 100,000 sheets of paper have passed. As the contact pressure P is increased, the amount of zinc stearate applied to the photoreceptor 21 increases, and the lubricant more easily moves to the charged roller 17 as well, as shown in FIG. 21. Therefore, the friction coefficient μ between the charged roller 17 and the cleaner roller 18 constantly decreases in a gradual manner. Examples of conventional cleaner rollers include electrostatically embedded brushes (filament length: 2 mm, deniers: 0.8 to 2, for example) and brushes embedded with insulating nylon, electroconductive nylon, or electroconductive triacetate. With this type of material, as the applied pressure P of the lubricant is increased, the reduced friction coefficient μ between the charged roller 17 and cleaner roller 18 considerably reduces the linked rotation, as shown in FIG. 21. As a result, the fine toner particles and the toner additives that have passed through the zinc stearate and the cleaning blade 33 form a film on the surface of the charged roller 17, and an abnormal image is generated. However, it was found that even if the contact pressure P is increased in the melamine foam used in the present embodiment and in the electrostatically embedded microfilaments in which segmented composite fibers have been segmented, the decrease in the friction coefficient μ is low, and linked rotation remains stable with the passage of time.

In the printer of the present embodiment, as shown in FIG. 16, the charged roller 17 and cleaner roller 18 are disposed below the photoreceptor 21, developing device 10, and other components. For this reason, the developer splashed from the developing device 10 sometimes enters into the bearing 14 of the charged roller 17 or the bearing 15 of the cleaner roller 18. With the gradual decrease in the particle diameter of the developer for high-quality images observed in recent years, splashing occurs more often and the developer enters the bearing in this fashion. It is for this reason that the bearing 14 of the charged roller 17 locks, the photoreceptor 21 is not uniformly charged, and abnormal images may be produced. There are also cases in which the bearing of the charged cleaning roller locks, and abnormal images are produced due to uneven charging, insufficient charging, and other charging problems. The sliding resistance increases in particular when a carrier or other substance with a particles size of 35 μm enters the bearing 14 of the charged roller 17. For this reason, the drive torque of the charged roller 17 increases, the force for separating the charged roller 17 from the photoreceptor 21 increases due to the pressure angle of the gear 23, and the gap between the photoreceptor 21 and charged roller 17 cannot be maintained and grows larger. Charging is therefore not carried out in a normal manner, and abnormal images may be produced.

In view of the above, the bearing 14 of the rotating shaft 17*a* of the charged roller is U-shaped, as shown in FIG. 21, and the rotating shaft 17*a* is configured to be driven by way of an oil-impregnated sintered collar 20. Developer can thereby be prevented from entering between the rotating shaft 17*a* and the bearing 14 and increasing the torque, and a stable image can be formed even with the passage of time.

Figure 23:
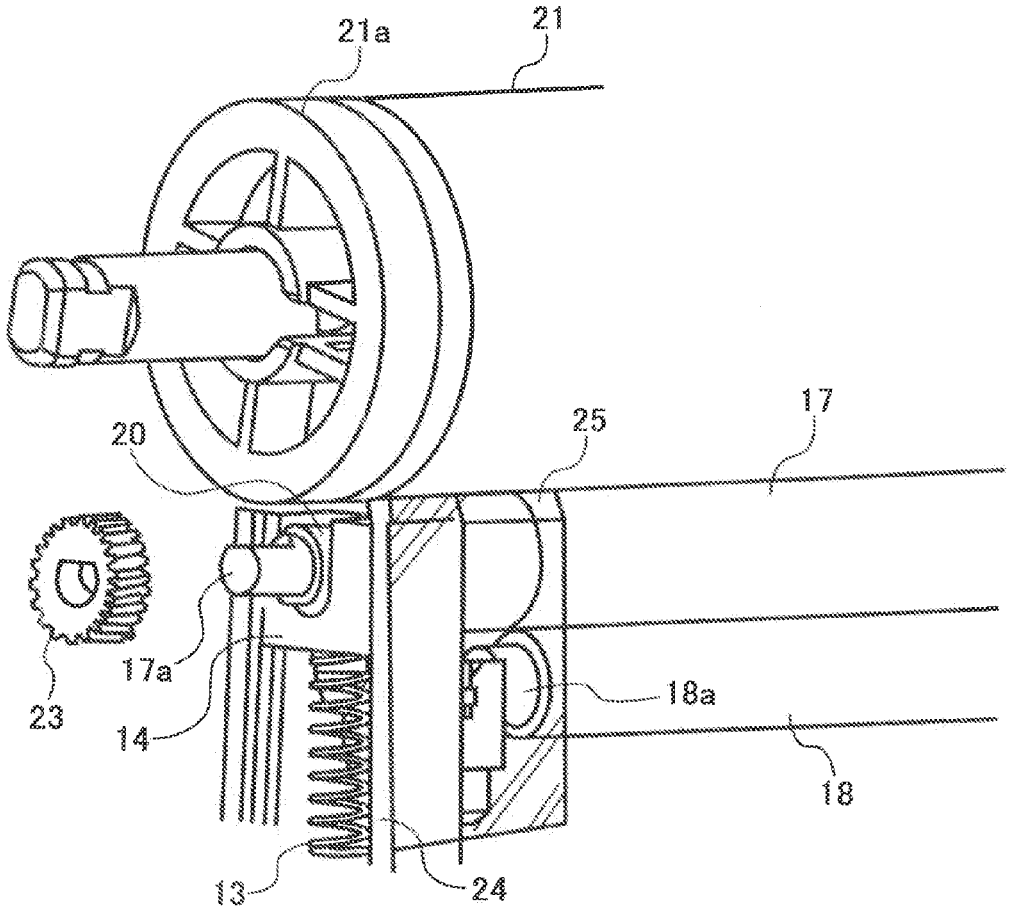
FIG. 23 is a general configurational diagram in which a cover is provided to the main body frame for holding the bearing.

Developer spilled from the developing device 10 is also deposited on the gap roller 17*a*, and the gap between the charged roller 17 cannot be maintained and may grow larger. In particular, when even a slight amount of carrier is deposited on the gap roller 17*b*, the photoreceptor 21 is markedly abraded between the photoreceptor 21 and gap roller 17*b*. In view of the above, a cover 25 is provided to the guide 24 of the frame of the main body for holding the bearing 14, as shown in FIG. 23. The cover 25 is affixed with a polyethylene terephthalate (PET) sheet, and the carrier or another developer that splashes from the developing device 10 is prevented from being deposited on the bearing 14, the rotating shaft 17*a*, the gap roller 17*b*, or another component.

Figure 24:
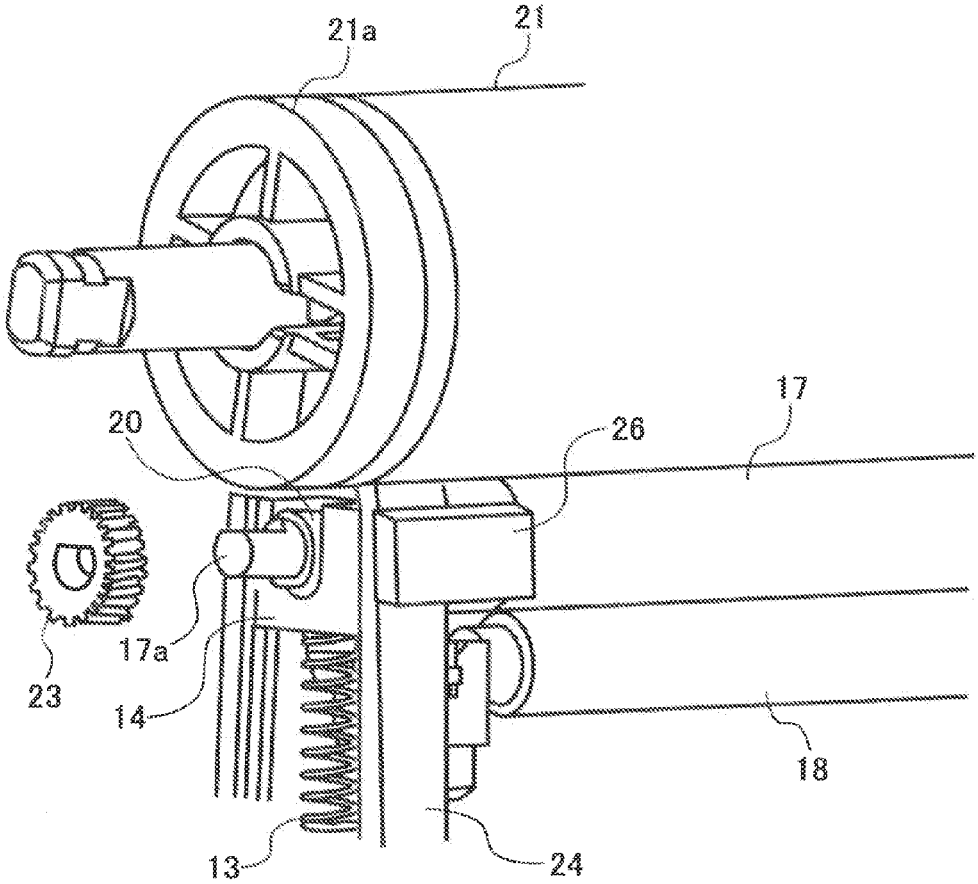
FIG. 24 is a general configurational diagram in which a magnet is provided to the main body frame for holding the bearing.

A magnet 26 is affixed to the guide 24 of the frame of the main body for holding the bearing so as to cover the bearing 14, as shown in FIG. 24. The carrier splashed from the developing device 10 is captured with the magnet 26. Thus, the carrier is further reliably prevented from being deposited on the gap roller 17*b* and abrading the photoreceptor 21. The magnet 25 can also prevent carrier that has gone around the end portion of the cleaning blade 33 from being deposited on the gap roller 17*b*.

Figure 25:
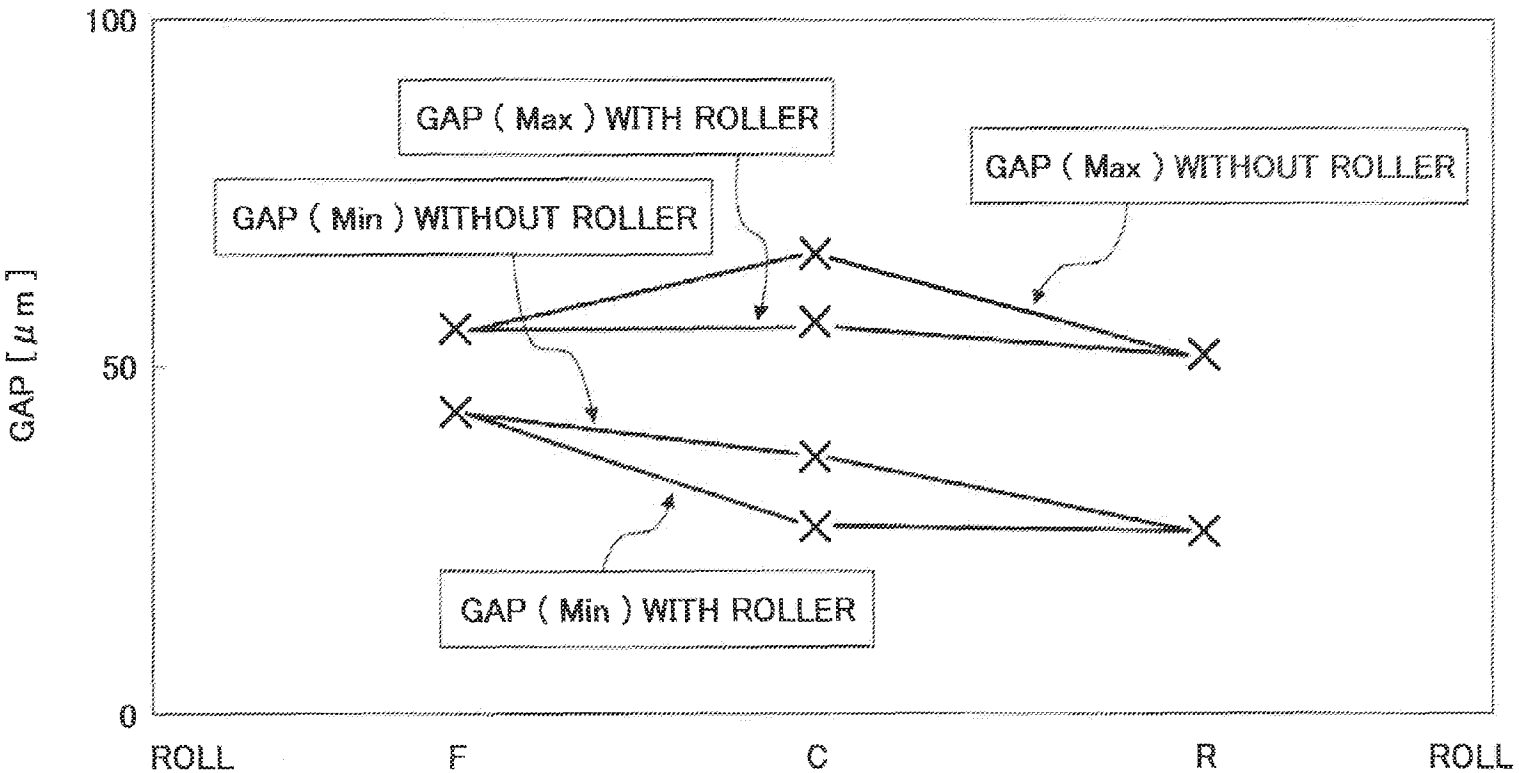
FIG. 25 is a diagram showing the displacement in the lengthwise direction of the gap between the photoreceptor and the charged roller.

In the case of the close proximity method, a very small gap can be maintained between the photoreceptor 21 and charged roller 17 to ensure uniform charging, so the bias of the small gap must be reduced in relation to the lengthwise direction of the charged roller 17. A gap roller 17*b* is provided at both ends of the charged roller 17 as described above so as to maintain the very small gap. In a lower side arrangement, however, there is a tendency for the gap to not be maintained in the center portion in the lengthwise direction due to the deadweight of the charged roller 17. In the present embodiment, the gap between the photoreceptor 21 and charged roller 17 is maintained at the edges by gap rollers 17*b*, while the cleaner roller 18 is brought into contact with suitable pressure from below across the entire range in the lengthwise direction. It is accordingly possible to maintain a small gap in a prescribed range in the center portion in the lengthwise direction. FIG. 25 shows the result of measuring the gap between the photoreceptor 21 and charged roller 17 in the end portion and center portion in the lengthwise direction in cases in which the cleaner roller 18 is pressed and not pressed into contact from below the charged roller 17. The gap was measured with an optical laser measuring instrument. When the charged roller 17 is not pressed by the cleaner roller 18, as shown in FIG. 25, the results vary significantly even if the gap is established at the edges. By contrast, when the charged roller 17 is pressed by the cleaner roller 18, a gap that substantially does not vary from the gap established at the edge is maintained in the center portion as well.

As described above, in the present embodiment, the cleaner roller 18 makes contact with the charged roller 17 in a state in which the bearing 15 of the cleaner roller 18 is movably held by way of spring 16 in the direction in which the charged roller 17 and cleaner roller 18 move toward or away from each other. The stress placed on the contact area is thereby reduced, the cleaning characteristics of the charged roller are maintained, and a stable charge can be imparted over a long period of time.

The contact force of the cleaner roller against the charged roller 17 is 15 to 50 mN/cm, and linked rotation can be stably maintained over a long period of time. If the pressing force is greater than 50 mN/cm, the sliding load of the bearing 15 of the rotating shaft 18*a* of the cleaner roller grows larger, and linked rotation becomes more difficult. If the pressing force is less than 15 mN/cm, the uneven surface of the cleaner roller 18 causes nonuniformity, and the cleaning characteristics are reduced.

Linked rotation can be stably maintained over a long period of time by setting the bearing contact surface area between the bearing 15 and the rotating shaft 18*a* of the cleaner roller to 3 to 20 $mm^2$. When the contact surface area is greater than 20 $mm^2$, the sliding resistance of the rotating shaft 18*a* increases, the frictional coefficient μ of the charged roller 17 and cleaner roller 18 may be reduced, and locking more easily occurs when carrier, toner, or other foreign matter enters into the bearings 14 and 15.

A reduction in the friction coefficient μ produced by the lubricating material applied to the photoreceptor 21 can be lessened, and linked rotation can be stably maintained over a long period of time by covering the surface of the cleaner roller 18 with melamine resin foam.

The cleaning characteristics can be made uniform by setting the compression ratio of the melamine resin foam to 20 to 50%.

A reduction in the friction coefficient μ produced by the lubricating material applied to the photoreceptor 21 can be lessened and linked rotation can be stably maintained over a long period of time by using embedded microfilaments in which segmented composite fibers have been embedded into the surface of the cleaner roller 18.

An oil-impregnated sintered collar 20 is provided to the rotating shaft 17*a* of the charged roller, and the bearing 14 and the rotating shaft are configured so as to allow rotation by way of the collar. Developer can thereby be prevented from entering between the rotating shaft 17*a* and the bearing 14 and increasing the torque, and stable images can be formed with the passage of time.

A cover 25 for covering the bearing 14 is provided to the bearing holder 24 for holding the bearing 14 of the rotating shaft 17*a* of the charged roller. Carrier or another developer that splashes from the developing device 10 is thereby prevented from being deposited on the bearing 14, the rotating shaft 17*a*, the gap roller 17*b*, and other components.

Carrier or another developer that splashes from the developing device 10 is prevented from being deposited on the bearing 14, the rotating shaft 17*a*, the gap roller 17*b*, and other components by providing a magnet 27 to the bearing holder 24 for holding the bearing 14 of the rotating shaft 17*a* of the charged roller.

A gap roller 17*b* is provided and a very small gap is maintained between the photoreceptor 21 and charged roller 17 to perform charging. At this time, a gap that substantially does not vary from the gap maintained at the edge is maintained in the center portion as well, and uniform charging can be performed by pressing the charged roller 17 with the cleaner roller 18 from below.

Maintenance is facilitated by using a process cartridge in which the photoreceptor 21, the charged roller 17, and the cleaner roller 18 are integrally formed.

In accordance with the present embodiment, excellent effects are obtained in that stable charging is performed over a long period of time and satisfactory images can be obtained when the charged cleaning roller is brought into contact with the charged roller surface at a point lower than the virtual horizontal plane containing the center of rotation of the charged roller to clean the charged roller surface.

Various modifications will become possible for those skilled in the art after receiving the teachings of the present disclosure without departing from the scope thereof.

What is claimed is:

1. A cleaning device provided with a cleaning member that is configured to make contact with cleaning target members, the cleaning device comprising:

the cleaning member, said cleaning member including a portion composed of melamine resin foam that is configured to make contact with at least the cleaning target members, wherein the melamine resin foam is configured to be used on the cleaning target members in a state obtained after the melamine foam has been compressed from an original shape in a radial direction of the cleaning member so as to have an Asker F hardness of 5 to 25 points, and, wherein the melamine resin foam is molded into the form of a roller.

2. The cleaning device as claimed in claim 1, wherein the melamine resin foam included in the cleaning member is mounted on a second metal roller.

3. The cleaning device as claimed in claim 1, wherein the cleaning member is provided so as to move toward or away from the cleaning target members.

4. The cleaning device as claimed in claim 1, wherein the cleaning member is configured to operate in conjunction with the cleaning target members using frictional force.

5. The cleaning device as claimed in claim 1, wherein the melamine resin foam includes a hardness variation of 5 points or less.

6. The cleaning device as claimed in claim 1, further comprising a pressing member that contacts the cleaning member.

7. The cleaning device as claimed in claim 6, wherein a ratio of the diameter of the cleaning member with respect to the pressing member is set to double or less, and contact is made whereby an amount of compression deformation of the cleaning member with respect to the pressing member is set to 1.5 mm or less.

8. The cleaning device as claimed in claim 6, wherein the pressing member comprises a metal roller, and is set in forced contact with the cleaning member.

9. An image-forming device comprising:

a cleaning device that includes a cleaning member configured to make contact with cleaning target members, the cleaning member including a portion composed of melamine resin foam that is configured to make contact with at least the cleaning target members, wherein the melamine resin foam is configured to be used on the cleaning target members in a state obtained after the melamine foam has been compressed from an original shape in a radial direction of the cleaning member so as to have an Asker F hardness of 5 to 25 points, and wherein the melamine resin foam is molded into the form of a roller.

10. The image-forming device as claimed in claim 9, further comprising:

a latent image carrier; and a charged device or transfer device disposed facing the latent image carrier, the charged device or the transfer device respectively being configured to be used as a charging device for the latent image carrier or a transferring device for the latent image carrier.

11. The image-forming device as claimed in claim 10, wherein the charged device is a charged roller or the transfer device is a transfer roller, and the cleaning member is disposed in contact with the charged roller or the transfer roller.

12. The image-forming device as claimed in claim 10, further comprising a process cartridge that houses the latent image carrier and at least one of the charged device and the transfer device such that at least one of the charge device and the transfer device are disposed facing the latent image carrier.

13. The cleaning device as claimed in claim 9, wherein the melamine resin foam includes a hardness variation of 5 points or less.

14. The cleaning device as claimed in claim 9, further comprising a pressing member that contacts the cleaning member.

15. The cleaning device as claimed in claim 14, wherein the pressing member comprises a metal roller, and is set in forced contact with the cleaning member.

* * * * *